US012796848B2

(12) United States Patent
Drouet

(10) Patent No.: US 12,796,848 B2
(45) Date of Patent: Nov. 17, 2026

(54) CUP, A BLANK FOR A CUP AND A METHOD OF FORMING A CUP

(71) Applicant: Choose Planet A Limited, Kowloon (CN)

(72) Inventor: Cyril Drouet, Kowloon (CN)

(73) Assignee: Choose Planet A Limited, Jordan (CN)

( * ) Notice: Subject to any disclaimer, the term of this patent is extended or adjusted under 35 U.S.C. 154(b) by 0 days.

(21) Appl. No.: 19/130,807

(22) PCT Filed: Nov. 17, 2023

(86) PCT No.: PCT/EP2023/082221
§ 371 (c)(1),
(2) Date: May 16, 2025

(87) PCT Pub. No.: WO2024/105241
PCT Pub. Date: May 23, 2024

(65) Prior Publication Data

US 2026/0007265 A1 Jan. 8, 2026

(30) Foreign Application Priority Data

Nov. 18, 2022 (GB) ..... 2217290
Jun. 9, 2023 (GB) ..... 2308658

(51) Int. Cl.
*A47G 19/22* (2006.01)
*B65D 3/08* (2006.01)
(Continued)

(52) U.S. Cl.
CPC ..... *A47G 19/2272* (2013.01); *B65D 3/08* (2013.01); *B65D 5/0209* (2013.01);
(Continued)

(58) Field of Classification Search
CPC .... A47G 19/2272; B65D 3/08; B65D 5/0209; B65D 5/0263; B65D 5/106; B65D 5/44;
(Continued)

(56) References Cited

U.S. PATENT DOCUMENTS 5,676,306 A * 10/1997 Lankin ..... B65D 3/20 229/5.5
D418,368 S 1/2000 Solland et al.
(Continued)

FOREIGN PATENT DOCUMENTS

| | | |
|---|---|---|
| CH | 318339 | 12/1956 |
| WO | WO2016158553 | 12/2017 |
| WO | WO2021073599 | 4/2021 |

OTHER PUBLICATIONS

PCT International Search Report for corresponding PCT Application No. PCT/EP2023/082221 dated Mar. 26, 2024, 6 pages.
(Continued)

*Primary Examiner* — Vishal Pancholi
(74) *Attorney, Agent, or Firm* — Lee & Hayes, P.C.

(57) ABSTRACT

Cup and blanks for cups. The cups comprising: a base; a wall extending from the base to a rim of the cup; and a lid arrangement including a flap extending from the rim and foldable inwards about a fold line coincident with at least part of the rim, to form at least part of a lid of the cup, wherein a part of the flap defines a spout portion extending from the rim and separable from the flap along an edge of the spout portion, and wherein a further part of the flap defines an aperture enlargement portion extending from the edge of the spout portion and separable from the flap and the spout portion along at least a part of an edge of the aperture enlargement portion.

25 Claims, 13 Drawing Sheets

(51) Int. Cl.

| | |
|---|---|
| ***B65D 5/02*** | (2006.01) |
| ***B65D 5/10*** | (2006.01) |
| ***B65D 5/40*** | (2006.01) |
| ***B65D 5/42*** | (2006.01) |

(52) U.S. Cl.
CPC ..... *B65D 5/0263* (2013.01); *B65D 5/106* (2013.01); *B65D 5/40* (2013.01); *B65D 5/4295* (2013.01)

(58) Field of Classification Search
CPC ..... B65D 5/4295; B65D 5/701; B65D 3/20; B65D 2203/12; B65D 2231/022
USPC ..... 229/404, 103.1, 138, 107, 200; 53/456, 53/457, 564, 565; 220/694, 703, 711, 220/714, 715, 62, 62.1
See application file for complete search history.

(56) References Cited

U.S. PATENT DOCUMENTS

| | | | | |
|---|---|---|---|---|
| 6,758,390 | B2 | 7/2004 | Sarson | |
| D495,209 | S | 8/2004 | Tranfaglia et al. | |
| D605,895 | S | 12/2009 | Abbott | |
| 7,726,551 | B2 * | 6/2010 | Abbott | B65D 3/06 229/5.5 |
| D637,872 | S | 5/2011 | Sarson | |
| D657,950 | S | 4/2012 | Herman | |
| 8,746,545 | B2 | 6/2014 | Houck | |
| 8,864,015 | B2 | 10/2014 | Lu et al. | |
| 9,737,161 | B1 * | 8/2017 | Li | B65D 3/08 |
| 9,751,655 | B2 | 9/2017 | Herman et al. | |
| 11,008,131 | B2 | 5/2021 | Herman et al. | |
| D984,884 | S | 5/2023 | Leeds et al. | |
| 11,999,538 | B2 * | 6/2024 | Learn | B65D 5/18 |
| 12,312,135 | B2 | 5/2025 | Leeds et al. | |
| D1,080,377 | S | 6/2025 | Leeds et al. | |
| 2015/0272361 | A1 * | 10/2015 | Herman | B65D 3/06 220/717 |
| 2018/0070750 | A1 * | 3/2018 | Li | B65D 3/08 |

OTHER PUBLICATIONS

Non-Final Office Action for corresponding Design U.S. Appl. No. 29/876,193 dated Aug. 1, 2025, 14 pages.

* cited by examiner

CUP, A BLANK FOR A CUP AND A METHOD OF FORMING A CUP

TECHNICAL FIELD

The invention relates to cups. In particular, the invention relates to disposable or recyclable cups commonly used in the food and beverage industry to store items purchased and optionally consumed off-premises.

BACKGROUND

Disposable items are common in today's society. Disposable Cups such as paper cups or plastic cups are commonly used in the food and beverage industry. These disposable items are often discarded or recycled after a single or limited use.

Food and drink cups are often provided with a separate lid to render the cup spill proof. These lids are often separate parts that are placed onto and secured to the cup after the cup is filled with liquid or solids e.g. drinks or food. The lid may then be removed by a user to access the drink or food, after which the lid may then be discarded or recycled along with the cup.

These separable lids often have to be processed e.g. recycled separate to the rest of the cup because they are made of a different material. In many instances, the lids are made from plastics which can be recycled but at greater costs compared with the cup.

Additionally, these removable lids can have some practical difficulties for the end user as they can often be incorrectly positioned onto the cup and in turn cause the cup to leak. In use, end users may need to make extra effort to correctly attach the lid to the cup such as by accurately aligning the lid with an upper edge of the cup whilst exerting an even force to ensure the lid is fitted to the edge of the cup. If the lid is not correctly positioned or misaligned, spillage can occur when a user is using the cup.

SUMMARY

According to an aspect of the invention, there is provided a cup comprising: a base; a wall extending from the base to a rim of the cup; and a lid arrangement including a flap extending from the rim and foldable inwards about a fold line coincident with at least part of the rim, to form at least part of a lid of the cup, wherein a part of the flap defines a spout portion extending from the rim and separable from the flap along an edge of the spout portion, and wherein a further part of the flap defines an aperture enlargement portion extending from the edge of the spout portion and separable from the flap and the spout portion along at least a part of an edge of the aperture enlargement portion.

Optionally, the edge of the spout portion comprises a cutline formed in the flap.

Optionally, the edge of the aperture enlargement portion comprises a cutline extending from the edge of the spout portion.

Optionally, the edge of the aperture enlargement portion comprises two cutlines extending from the edge of the spout portion, wherein distal ends of the two cutlines are connected by a foldable connection allowing the aperture enlargement portion to be folded relative to the flap.

Optionally, the edge of the spout portion comprises a frangible connection between the spout portion and the flap.

Optionally, the edge of the aperture enlargement portion comprises a frangible connection extending from the edge of the spout portion.

Optionally, the spout portion is frangibly connected to the aperture enlargement portion such that are retained in alignment.

Optionally, the frangible connection between the spout portion and the aperture enlargement portion is configured to break under a force applied by a user when folding the front flap inwards.

Optionally, the frangible connection between the spout portion and the aperture enlargement portion is configured not to break under a force applied by a user when folding the front flap inwards.

Optionally, the spout portion is configured to be separable from the flap upon the flap being folded about the fold line to form a spout from which liquid may flow out of the cup.

Optionally, the fold line is interrupted where the spout portion extends from the rim.

Optionally, the fold line is arced outwards in a plane parallel with the base, such that the spout includes a singly curved surface.

Optionally, separation of the spout portion from the flap creates an aperture in the lid.

Optionally, at least a part of the edge of the aperture enlargement portion is foldably connected to the flap, such that the aperture enlargement portion may be folded inwards on application of an inward force.

Optionally, the aperture enlargement portion and/or the spout portion are sized to support a straw inserted into the enlarged aperture.

Optionally, the aperture enlargement portion and/or the spout portion are sized such that at least one internal dimension of the enlarged aperture is substantially the same as an outer dimension of the straw.

Optionally, at least a part of an outer edge of the aperture enlargement portion is shaped to follow an outer dimension of the straw.

Optionally, the flap is a front flap and the fold line is a front fold line, the lid arrangement further comprising a rear flap extending from an opposite side of the rim to the front flap, and wherein the rear flap is foldable inwards about a rear fold line to form at least a part of the lid of the cup.

Optionally, the front flap extends from the rim by a distance substantially equal to a distance from the front fold line to the rear fold line, and wherein the rear flap extends from the rear fold line by distance less than a distance to an outer edge of the aperture, and/or wherein, when dependent directly or indirectly on claim 6, the rear flap extends from the rear fold line by distance less than a distance from the rear fold line to an outer edge of the enlarged aperture.

Optionally, the cup further comprises a pair of opposed side flaps extending from the rim and foldable inwards about lateral fold lines to form at least a part of the lid of the cup.

Optionally, the pair of opposed side flaps include a front portion and a rear portion, wherein the rear portion is foldable about the lateral fold lines, wherein the front portion is foldably connected to the front flap, and wherein the front and rear portions are foldable connected along oblique fold lines.

Optionally, the rear flap is not connected to the front flap or either of the side flaps.

Optionally, the fold line comprises one or more vent cut lines, each vent cut line forming a shape that oscillates about the fold line such that, when the flap is folded about the fold line, each vent cut line forms a lid vent and a wall vent.

Optionally, the rear fold line comprises one or more further vent cut lines, each further vent cut line forming a shape that oscillates about the rear fold line such that, when the rear flap is folded about the rear fold line, each further vent cut line forms a lid vent and a wall vent.

According to an aspect of the invention, there is provided a blank for forming a cup, comprising: a wall section for forming a wall of the cup and defining a base of the cup and a rim of the cup; a lid arrangement including a flap extending from the rim and foldable inwards about a fold line coincident with at least part of the rim, to form at least part of a lid of the cup, wherein a part of the flap defines a spout portion extending from the rim and separable from the flap along an edge of the spout portion, and wherein a further part of the flap defines an aperture enlargement portion extending from the edge of the spout portion and separable from the flap and the spout portion along at least a part of an edge of the aperture enlargement portion.

According to an aspect of the invention, there is provided a cup, comprising: a base; a wall extending from the base to a substantially rectangular rim; and a lid arrangement, wherein the lid arrangement includes: a front flap extending from a front side of the rim and foldable inwards about a front fold line coincident with at least part of the front side of the rim; a rear flap extending from a rear side of the rim and foldable inwards about a rear fold line coincident with at least a part of the rear side of the rim; and a pair of opposed side flaps extending from the rim and foldable inwards about lateral fold lines coincident with at least a lateral side of the rim, wherein the wall includes a seam formed by overlapping and adhering two wall sections, such that the wall is double thickness at the seam, and wherein the seam extends from a corner of the rim towards the base.

Optionally, the pair od opposed side flaps are foldably connected to the front flap, and wherein the seam extends from an end of the rear side of the rim.

Optionally, the pair of opposed side flaps include a front portion and a rear portion, wherein the rear portion is foldable about the lateral fold lines, wherein the front portion is foldably connected to the front flap, and wherein the front and rear portions are foldable connected along oblique fold lines.

Optionally, the rear flap is not connected to the front flap or either of the side flaps.

Optionally, the wall includes one or more rim forming fold lines extending from one or more corners of the rim towards the base.

Optionally, the rear flap comprises a tongue extending therefrom, and wherein the front flap comprises a slit arrangement comprising a tongue receiving portion, the tongue receiving portion being foldable inwards, and wherein the tongue and the slit arrangement are configured such that, when the rear flap is folded onto the front flap, the tongue engages the tongue receiving portion, which is folded inwards to create at least one vent aperture in the lid arrangement.

Optionally, the at least one vent aperture is located on the lid arrangement to be substantially aligned with at least one nostril of a user of the cup whilst drinking therefrom.

Optionally, the tongue comprises a neck and at least one shoulder on at least one side of the neck, wherein the tongue receiving portion comprises at least one shoulder retaining edge, and wherein, when the rear flap is folded onto the front flap, the neck engages with the tongue receiving portion, folding it inwards, and the at least one shoulder engages an underside of the at least one shoulder retaining edge for retaining the tongue in a position to hold the tongue receiving portion in an inwardly folded configuration.

Optionally, the cup further comprises a spout portion comprising: a liftable flap forming part of the front panel and comprising at least one cutline and a fold line arranged such that the liftable flap may be folded over onto a surface of a lid of the cup to form an aperture therein; a deviation fold line causing a deviation in the front fold line and extending into the wall of the cup, the deviation fold line and being offset from the at least one cutline of the liftable flap; at least one oblique spout forming fold line extending from the deviation fold line to the at least one cut line, wherein the at least one cutline of the liftable flap, the deviation fold line and the oblique spout forming fold lines are configured such that when the front flap is folded inwards, a spout region is formed, extending from the wall of the cup and standing proud of the surface of the lid.

Optionally, a spout forming fold line is formed by the front fold line, the deviation fold line, the oblique spout forming fold lines and the at least one cutline, and wherein the front flap folds about a spout forming fold line.

Optionally, the at least one cutline of the liftable flap extends beyond the spout forming fold line for forming a lip allowing a user to gain purchase when lifting the liftable flap.

Optionally, the spout portion further comprises at least one spout raising fold lines extending from the front fold line into the front flap, wherein the spout raising fold lines are angled inwards towards the liftable flap such that, when the front flap is folded inwards, angled surfaces are formed from the spout region to the surface of the lid.

Optionally, the front fold line and/or the rear fold line comprises one or more vent cut lines, each vent cut line forming a shape that oscillates about the front fold line or the rear fold line such that, when the front flap or the rear flap is folded about the front fold line or the rear fold line, each vent cut line forms a lid vent and a wall vent.

According to an aspect of the invention, there is provided a cup, comprising: a base; a wall extending from the base to a substantially rectangular rim; and a lid arrangement including a flap extending from the rim and foldable inwards about a fold line coincident with at least part of the rim, to form at least part of a lid of the cup, wherein the fold line comprises one or more vent cut lines, each vent cut line forming a shape that oscillates about the fold line such that, when the flap is folded about the fold line, each vent cut line forms a lid vent and a wall vent.

Optionally, the flap is a front flap and the fold line is a front fold line, the lid arrangement further comprising a rear flap extending from an opposite side of the rim to the front flap, and wherein the rear flap is foldable inwards about a rear fold line to form at least a part of the lid of the cup, the rear fold line comprising one or more further vent cut lines, each further vent cut line forming a shape that oscillates about the rear fold line such that, when the rear flap is folded about the rear fold line, each further vent cut line forms a lid vent and a wall vent.

Optionally, the vent cut line and/or the further vent cut line forms an S-shape.

Optionally, a central section of the front fold line and/or the rear fold line remains intact, such that the front flap and/or the rear flap is connected to the wall at the central section of the front fold line and/or the rear fold line.

According to an aspect of the invention, there is provided a blank for forming a cup, comprising: a wall section for forming a wall of the cup, the wall section extending from a base to a rim, wherein the rim includes four side sections that create a substantially rectangular shape when the blank is formed into a cup; and a lid arrangement, wherein the lid arrangement includes: a front flap extending from a front side of the rim and foldable inwards about a front fold line coincident with at least part of the front side of the rim; a rear flap extending from a rear side of the rim and foldable inwards about a rear fold line coincident with at least a part of the rear side of the rim; and a pair of opposed side flaps extending from lateral sides of the rim and foldable inwards about lateral fold lines coincident with at least a part of the rim, wherein the wall section includes a flap extending from the base to the rim at an edge of the wall section, wherein, the flap is configured to overlap a portion of the wall section at an opposite edge to create a seam when the cup is formed from the blank, such that the wall is double thickness at the seam, and wherein the seam extends from a corner of the rim towards the base.

According to an aspect of the invention, there is provided a cup, comprising: a base; a wall extending from the base to a substantially rectangular rim; and a lid arrangement, wherein the lid arrangement includes: a front flap extending from a front side of the rim and foldable inwards about a front fold line coincident with at least part of the front side of the rim; a rear flap extending from a rear side of the rim and foldable inwards about a rear fold line coincident with at least a part of the rear side of the rim; and a pair of opposed side flaps extending from the rim and foldable inwards about lateral fold lines coincident with at least a lateral side of the rim, wherein the front flap comprises a slit arrangement comprising a tongue receiving portion, the tongue receiving portion being foldable inwards, and wherein the tongue and the slit arrangement are configured such that, when the rear flap is folded onto the front flap, the tongue engages the tongue receiving portion, which is folded inwards to create at least one vent aperture in the lid arrangement.

According to an aspect of the invention, there is provided a cup, comprising: a base; a wall extending from the base to a substantially rectangular rim; and a lid arrangement, wherein the lid arrangement includes: a front flap extending from a front side of the rim and foldable inwards about a front fold line coincident with at least part of the front side of the rim; a rear flap extending from a rear side of the rim and foldable inwards about a rear fold line coincident with at least a part of the rear side of the rim; and a pair of opposed side flaps extending from the rim and foldable inwards about lateral fold lines coincident with at least a lateral side of the rim, wherein the cup further comprises a spout portion comprising: a liftable flap forming part of the front panel and comprising at least one cutline and a fold line arranged such that the liftable flap may be folded over onto a surface of a lid of the cup to form an aperture therein; a deviation fold line causing a deviation in the front fold line and extending into the wall of the cup, the deviation fold line and being offset from the at least one cutline of the liftable flap; at least one oblique spout forming fold line extending from the deviation fold line to the at least one cut line, wherein the at least one cutline of the liftable flap, the deviation fold line and the oblique spout forming fold lines are configured such that when the front flap is folded inwards, a spout region is formed, extending from the wall of the cup and standing proud of the surface of the lid.

According to aspects of the invention, there are provided blanks for forming the cups described above.

BRIEF DESCRIPTION OF THE DRAWINGS

Embodiments of the disclosed methods and apparatus will be described in detail below, with reference to the accompanying drawings, in which.

DETAILED DESCRIPTION

Generally, disclosed herein is a cup with one or more flaps extending from an upper rim and forming a closable (and openable) lid. The lid can be opened and closed by folding the flap(s) inward to define the lid in a closed position. The integrated lid makes it simpler to close the cup as compared to a separate lid that has to be pushed onto the cup. Further, the cup with an integrated lid may be reused or may be recycled as a single item. The integrated lid reduces the number of components required to be used by a food or beverage supplier, and can help to reduce the overall waste produced.

Exemplary cups disclosed herein include a spout arrangement. As the flap(s) are folded inward from an upright position, a portion of a flap remains upright. A spout is formed that extends vertically from the rim of the cup. A spout aperture is left in the lid (which is formed by the flap), through which liquid may flow from the cup out of the spout when the cup is tilted. An aperture enlargement portion may extend from the spout aperture. The aperture enlargement portion may be frangibly connected to the flap (and optionally include a foldable connection to the flap), such that it may be punched through. In other arrangements, the aperture enlargement portion may be formed by a cut line between the aperture enlargement portion and the flap, and may include a foldable connection to the flap, such that it is foldable inwards on application of an inward force. This enlarges the spout aperture to accommodate, for example, a straw.

Exemplary cups disclosed herein have a side seam, resulting from a blank being formed into a cup. The side seam is positioned to accommodate folding of the flap(s) when defining the closable lid. In particular arrangements, an upper rim of the cup forms a generally rectangular shape. The generally rectangular shape may be a rectangle with at least one arced side. The generally rectangular shape may be a rectangle with two arced sides and two straight sides. In such arrangements, the side seam may be positioned on a wall of the cup such that it extends downwards from a corner of the generally rectangularly shaped rim. This means that the seam does not need to extend into the flaps and so does not hinder folding of the flaps to close the lid.

Figure 1:
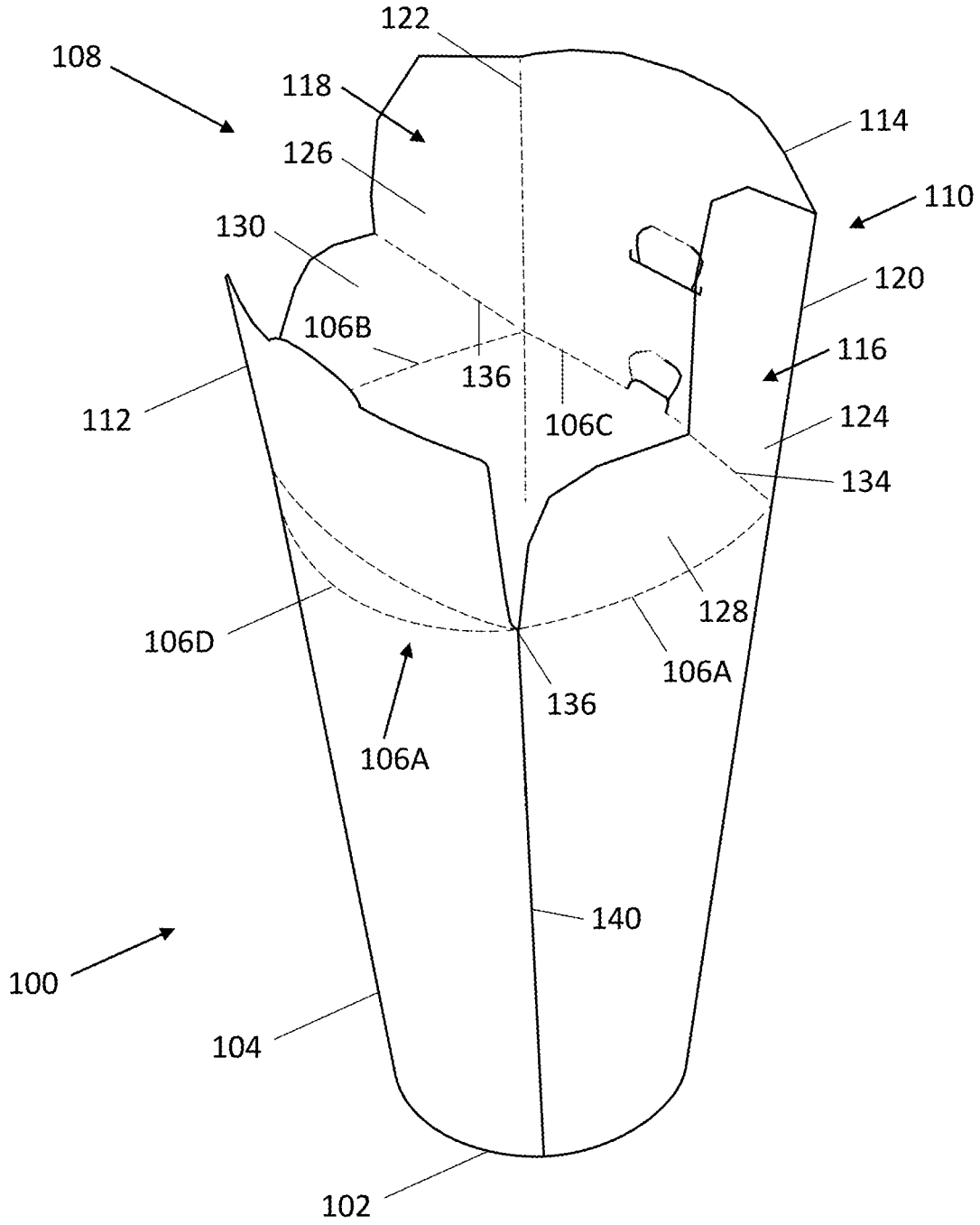
FIG. 1 shows an example form of a cup with a lid arrangement in an open position.

FIG. 1 illustrates an exemplary cup 100 for retaining a liquid or a solid within it. The cup 100 comprises a base 102 and wall 104. The wall 104 is attached to the base 102 and extends upward from the base 102. The wall 104 terminates at a rim 106.

It is noted that the term rim is used to aid description and to relate the cup 100 to a standard cup. The term rim encompasses a shape of the cup 100 when the lid is in a closed configuration, i.e. when the cup is in use as a drinking vessel. The term rim need not mean that an edge is formed, but can be related to the portion of a standard cup where an edge and an opening would be formed.

The wall 104 is a continuous wall. The base 102 is generally circular. The rim 106 is generally rectangular. The rim 106 may have a 'squashed' rectangular shape, in which two opposed sides are straight and the two other opposed sides are arced. In one example, the two arced sides are bowed outwards. The two arced sides may be the front side and the rear side. The two straight sides may be the lateral sides. The sides of the generally rectangular rim 106 are formed by fold lines 106A-D when the lid arrangement 108 is closed.

The cup 100 comprises a closable lid arrangement 108. The lid arrangement 108 is integrated with the wall 102 and extends from the rim 106. The lid arrangement 108 may be folded to a closed position and unfolded to an open position.

The lid 108, the wall 104 and the base 102 may all be formed from the same material. For example, in one form the cup 100 may be formed from paper or a paper board. In another form the cup 100 (i.e. the base 102, wall 104 and the lid 108) may be formed from a cardboard. In a further form the cup 100 may be formed from a natural fibre material e.g. jute. In a further form the cup 100 may be formed from a composite material comprising natural fibres and synthetic fibres. In a further form the cup 100 may be formed from a plastics material or a polymer e.g. a thermoplastic polymer. In a further form the cup 100 may be formed from a recycled plastic material or a recyclable plastic material.

The cup 100 may be any suitable size. The cup 100 may be sized to have a volume of between 4 oz to 20 oz. For example, the cup 100 may be sized to have a volume of any one of 4 oz, 5 oz, 6 oz, 7 oz, 8 oz, 9 oz, 10 oz, 12 oz, 16 oz, 20 oz. Alternatively the cup 100 may sized and shaped to define any suitable volume.

The shape of the cup allows it to be stackable with the base 102 being nestable within the rim 106 and thus allowing for a plurality of cups to be stacked together for storage or transportation.

Figure 2:
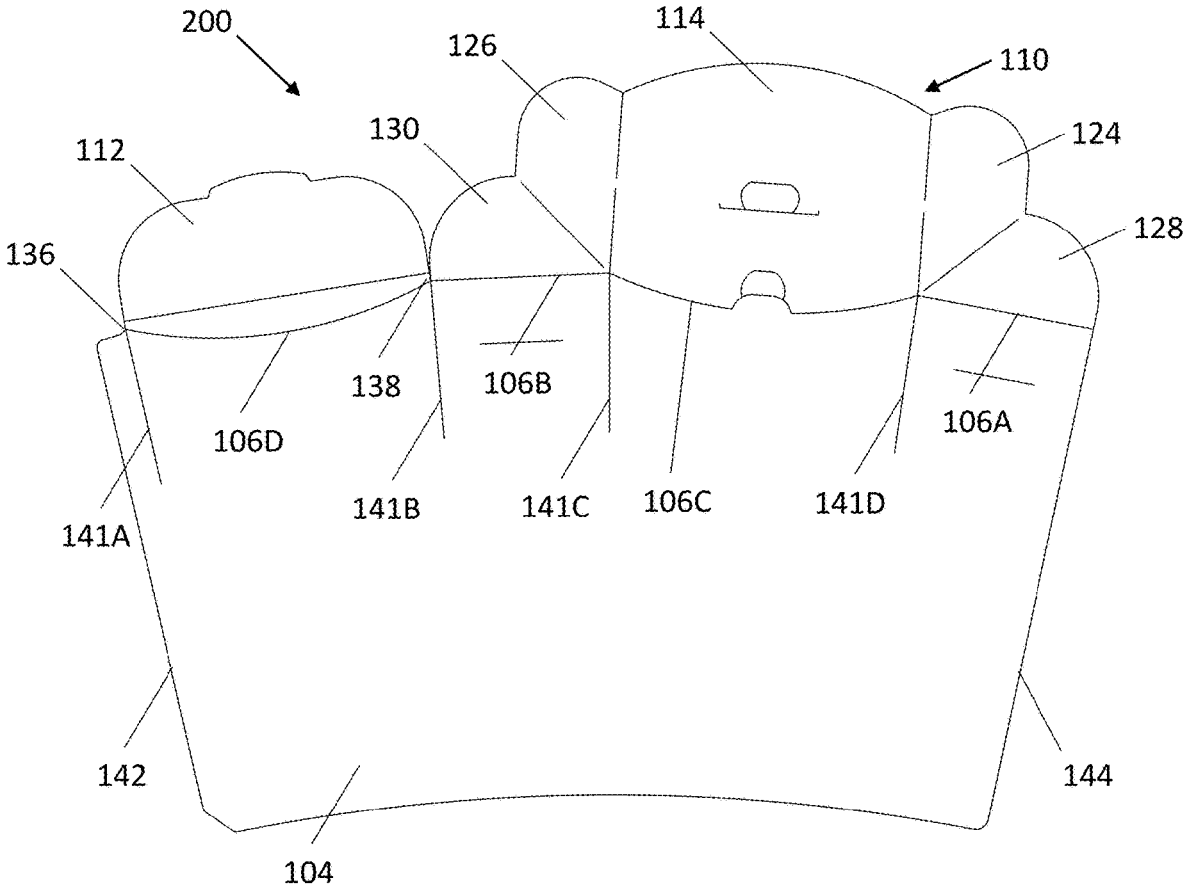
FIG. 2 shows an example form of a blank for forming a cup.

Referring to FIG. 1 and FIG. 2, the lid arrangement 108 comprises two flaps: a first closure flap 110, and a second (rear) closure flap 112. The first closure flap 110 and the second closure flap 112 extend vertically from the rim 106 in a direction continuing from a direction in which the wall 104 extends from the base 102. The first closure flap 110 extends around three sides of the generally rectangular rim 106. In the example shown in FIG. 1, the first closure flap 110 extends around a front side and the two lateral sides of the rim 106.

The first closure flap 110 includes a front flap 114 and two side flaps 116, 118. The front flap 114 is foldable relative to the wall 104 about a fold line 106C, which forms the front side of the rim 106. The side flaps 116, 118 are adjacent to the front flap 114 and opposite each other. The side flaps 116, 118 are foldable relative to the wall 104 about fold lines 106A and 106B, which form lateral sides of the rim 106. The front flap 114 extends along an arced side of the generally rectangular rim 106. The second closure flap 112 is foldable relative to the wall 104 about a fold line 106D that forms the rear side of the rim 106 and is opposite the front flap 114. The rear fold line 106D may be arced.

Each of the flaps of the lid arrangement 108 is foldable along a fold line coincident with a corresponding portion of the rim 106. In addition, each of the side flaps 116, 118 is foldably connected to the front flap along vertical fold lines 120, 122. Further, each side flap 116, 118 is split into a front portion 124, 126 and a rear portion 128, 130. The front portions 124, 126 are connected to the front flap 114 by the vertical fold lines 120, 122. The rear portions 128, 130 are connected to the wall 104 by the lateral fold lines 106A, 106B. The front portions 124, 126 and rear portions 128, 130 of each side flap 116, 118 are foldably connected along oblique fold lines 132, 134.

The rear flap 112 is adjacent the rear portions 128, 130 of the side flaps 116, 118 at two corners 136, 138 (not seen in FIG. 1) of the generally rectangular rim 106. The rear flap 112 is not connected to the side flaps 116, 118. Notches are formed at the corners 136, 138 where the rear flap 112 and the rear portions 128, 130 of the side flaps 116, 118 extend downwards to the rim 106. The rear flap 112 is foldable independently of the side flaps 116, 118. The rear flap 112 is not connected to the side flaps.

A side seam 140 is formed on the wall 104. The seam 140 is a result of creating the cup 100 from a blank 200, shown in FIG. 2. The blank 200 is wrapped around so that an edge 142 meets an edge 144, thereby creating the seam 140 when the edges are joined. It will be seen that the edge 142 extends further than is necessary so as to form a flap that overlaps and is adhered to a corresponding portion of the wall 104 at the edge 144.

The seam runs from a corner 136 of the rim 106 where the rear flap 112 is adjacent to one of the side flaps 116, 118. As a result, the seam stops at the rim 106 and does not extend into the lid arrangement 108. Accordingly, the seam 140 does not interfere with the closing of the lid arrangement 108.

If the seam 140 were positioned such that it extended to the base 102 from any other part of the rim 106 then it would extend into the first flap 110 or the second (rear) flap 112. Because the seam 140 is double the thickness of the wall 102, this would make folding the flaps 110, 112 more difficult and would lead to a greater chance of liquid leaking out of the lid 108 when it is closed.

The wall 104 also includes rim forming fold lines 141A-D. These help create the substantially rectangular rim 106 by encouraging the corners to be formed as the blank 200 is formed into the cup 100.

Figure 3:
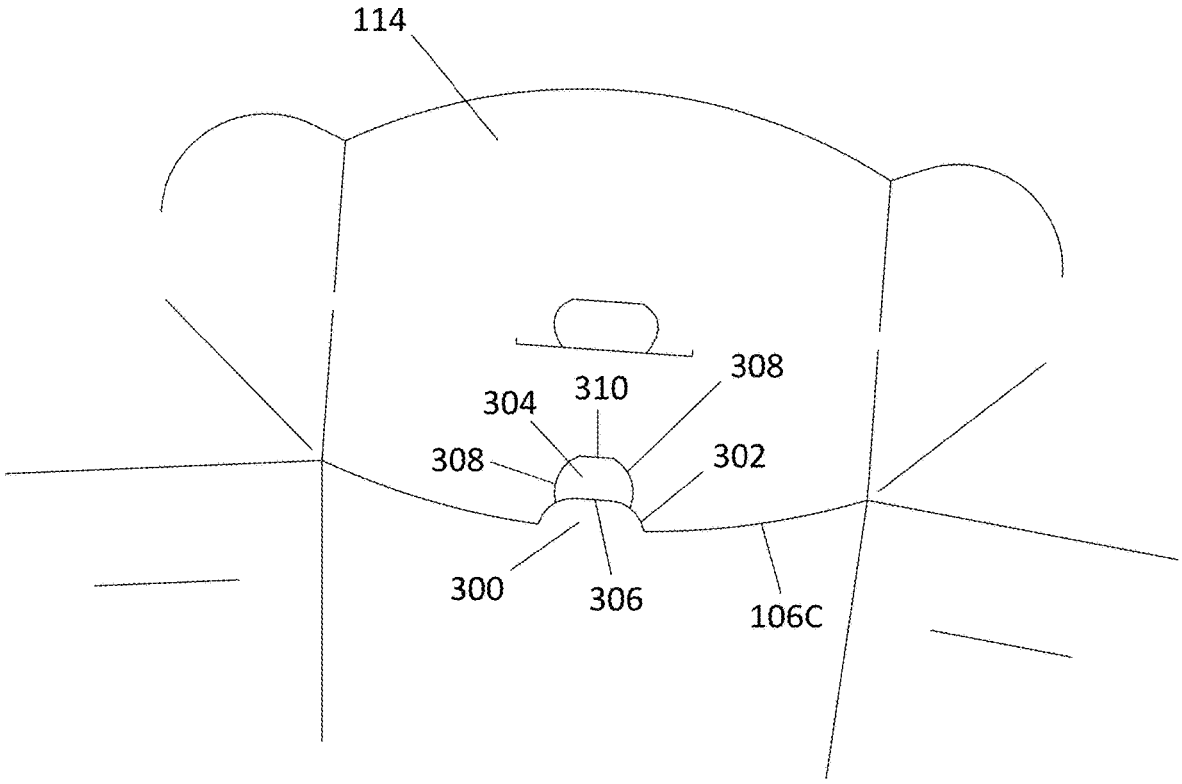
FIG. 3 shows an enlarged view of a section of the blank of FIG. 2.

FIG. 3 shows an enlarged view of the front flap 114 of the cup 100 (and the blank 200). The front flap 114 includes a spout portion 300. The spout portion 300 is configured to remain in position when the remainder of the front flap 114 is folded inwards when closing the lid arrangement 108. That is, the spout portion 300 remains in a position extending from the rim 106 in a direction aligned with the wall 104 when the front flap 114 is folded inwards.

The front flap 114 is connected to the wall 104 along a front fold line 106C that forms an arced front side of the generally rectangular rim 106. The fold line 106C is interrupted at the spout portion 300. The fold line 106C stops at the spout portion 300. The spout portion 300 is a continuous extension of the wall 104. The spout portion 300 is not joined to the wall 104 by a fold line. An outer edge 302 of the spout portion 300 extends into the front flap 114 and comprises a cut line or an otherwise frangible connection configured to break under a force applied to the front flap 114 when folding it inwards. Therefore, as the front flap 114 folds, the spout portion 300 remains in position. This leaves an aperture in the front flap 114 where the spout portion 300 was previously, and forms an extended spout to aid drinking.

The fold line 106C (and corresponding side of the generally rectangular rim 106) may be arced downwards in a plane transverse to the base 102. This creates tension in the folded front flap 114 that biases the front flap 114 into a locked position when closed, as explained below. The fold line 106C may be arced and bowed outwards in a plane parallel to the base 102 to create a singly curved inner face of the spout portion 300 when the lid arrangement 108 is closed. This provides additional stability to the spout portion 300 in use.

The front flap 114 includes an aperture enlargement portion 304. The aperture enlargement portion 304 extends from the outer edge 302 of the spout portion 300 into the front flap 114. A part 306 of the outer edge 302 of the spout portion 300 forms a part of an edge of the aperture enlargement portion 304. A further part 308 of the outer edge of the aperture enlargement portion 304 is formed by a cutline or a frangible connection between the aperture enlargement portion 304 and the front flap 114. The aperture enlargement portion may be pushed through on application of a force in an inward direction by a user to form an enlarged aperture, for example by pushing a straw into the aperture enlargement portion 304 when the lid arrangement 108 is closed. In the exemplary arrangement shown, a further part 310 of the outer edge of aperture enlargement portion 304 is foldably connected to the front flap by, for example a fold line or other foldable connection.

The outer edges 308, 310 of the aperture enlargement portion 304 (and therefore the enlarged aperture) may be sized to accommodate a particular straw with a tight, or interference fit. That is the dimensions of at least a part of the aperture enlargement portion (and enlarged aperture) may have broadly the same dimensions as a particular straw. Accordingly, the straw may be supported by an outer edge of the enlarged aperture during use.

FIGS. 4A-4F show operation of the lid arrangement 108 of the cup 100.

Figure 4A:
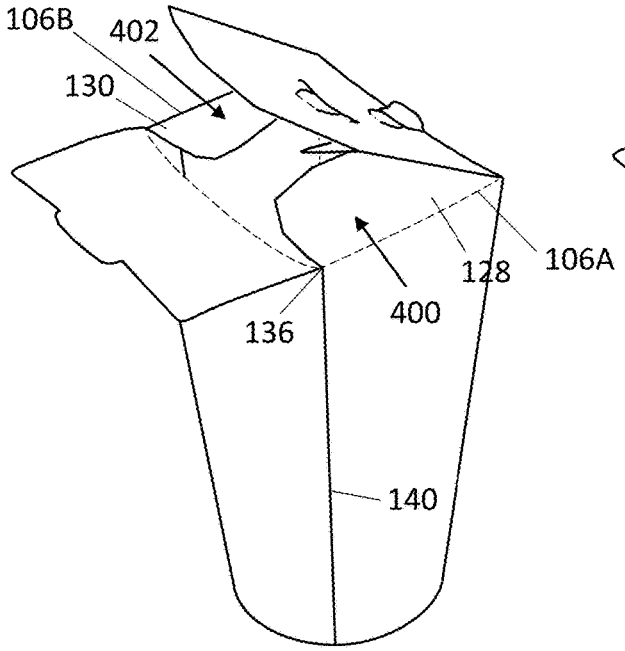
FIGS. 4A-4F show different stages of closing a lid arrangement of a cup.

Referring to FIG. 4A, the rear portions 128, 130 of the side flaps 116, 118 are folded inwards about the fold lines 106A, 106B under a force applied in the direction of arrows 400, 402. The connection of the rear portions 128, 130 to the front portions 132, 134 of the side flaps 116, 118 along the oblique fold lines 134, 136 causes the front portions 124, 126 to fold inwards relative to the front flap 114 along the vertical fold lines 120, 122 under the force 400, 402 applied to the rear portions 128, 130. The front panel 114 folds inwards about the fold line 106C under the force 400, 402 applied to the rear portions 128, 130.

The seam 140 extends from the corner 136 towards the base. The corner 136 of the rim 106 is one of the corners 136, 138 at which the side flaps 116, 118 and the rear flap 112 terminates. This means that the side flaps 116, 118 and the rear flap 112 may be folded inwards without interference from the seam 140.

Figure 4B:
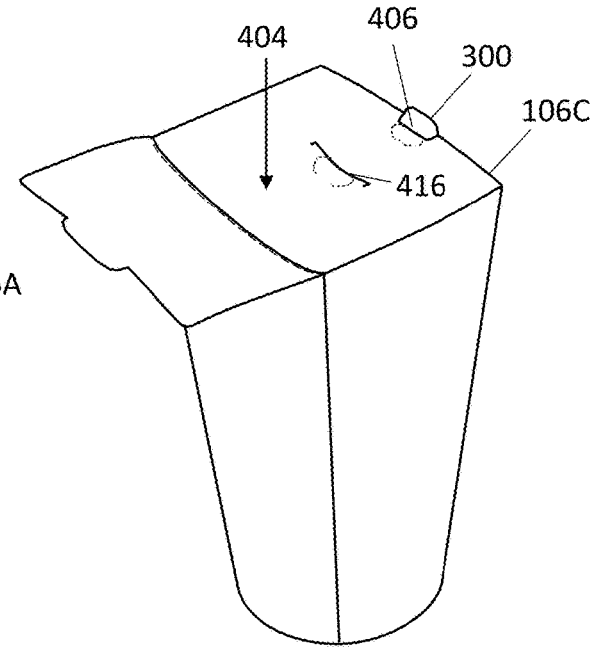

Referring to FIG. 4B, a downward force 404 is applied to the front flap 414 to close it. The front portions 124, 126 and rear portions 128, 130 of the side flaps 116, 118 fold under the front flap 414. The spout portion 300 remains upright and extends from the fold line 106C. This leaves an aperture 406 in the close front flap 414 out of which liquid retained in the cup 100 may flow.

Figure 4C:
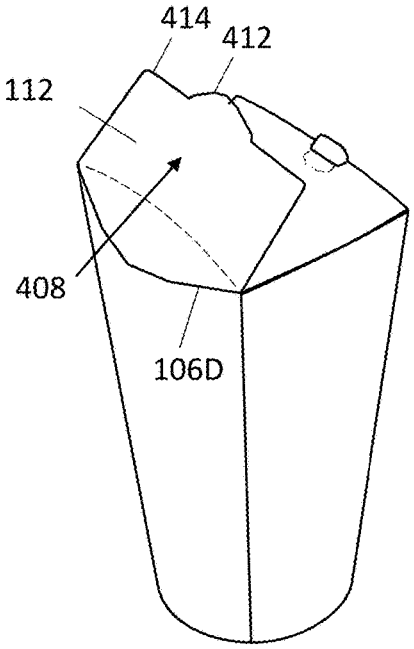
Figure 4D:
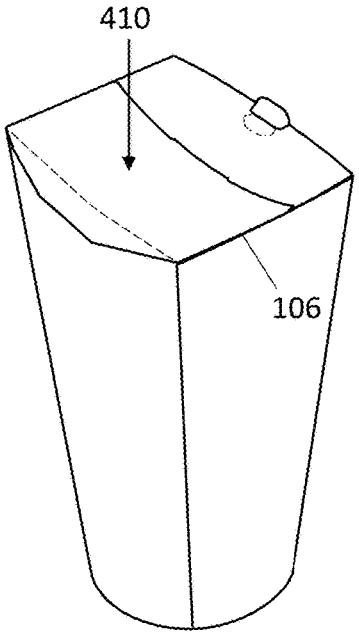

Referring to FIG. 4C, the rear flap 112 is folded inwards, over the front flap 114, about the fold line 106D under a force 408 applied by the user. Because the seam 140 extends towards the base 102 from the corner 136, it does not interfere with the folding of the rear flap 112. The rear flap 112 is folded over to meet the front flap 114 and pushed downwards under a force 410, applied by the user. As the rear flap 112 and the front flap 114 are pushed below the height of the rim 106, a tongue 412 extending from a distal edge 414 of the rear flap 112 locates within a slit 416 in the front flap 114. The arced fold lines 106C, 106D about which the front flap 114 and the rear flap 112 are folded form the front flap 114 and rear flap 112 into single curved surfaces when they are in the closed position. This generates tension in the front flap 114 and rear flap 112 that biases them in an upwards direction, locking the lid arrangement 108 closed.

Figure 4E:
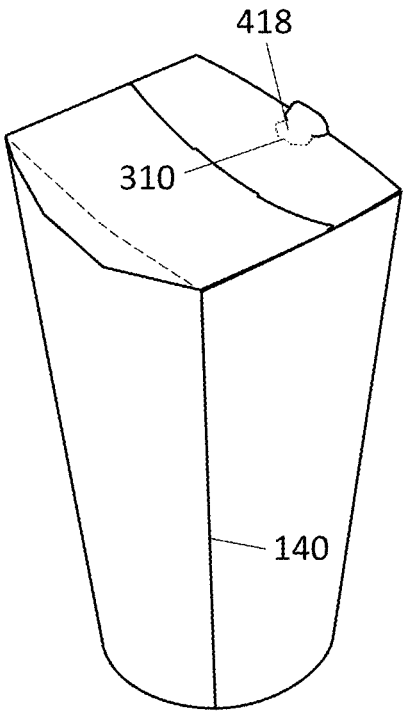
Figure 4F:
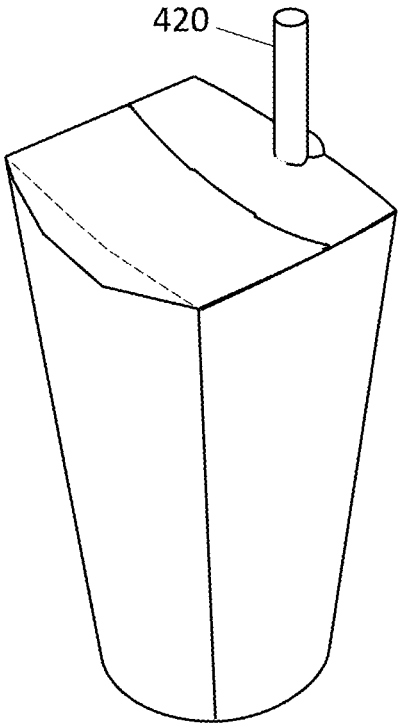

In FIG. 4E, the aperture enlargement portion 304 has been pushed through such that it folds inwards about the foldable connection of the aperture enlargement portion 310. This creates an enlarged aperture 418 in the front flap 114. In FIG. 4F, a straw 420 has been inserted into the enlarged aperture 418. The insertion of the straw 420 may be used to push through the aperture enlargement portion 304.

Figure 5:
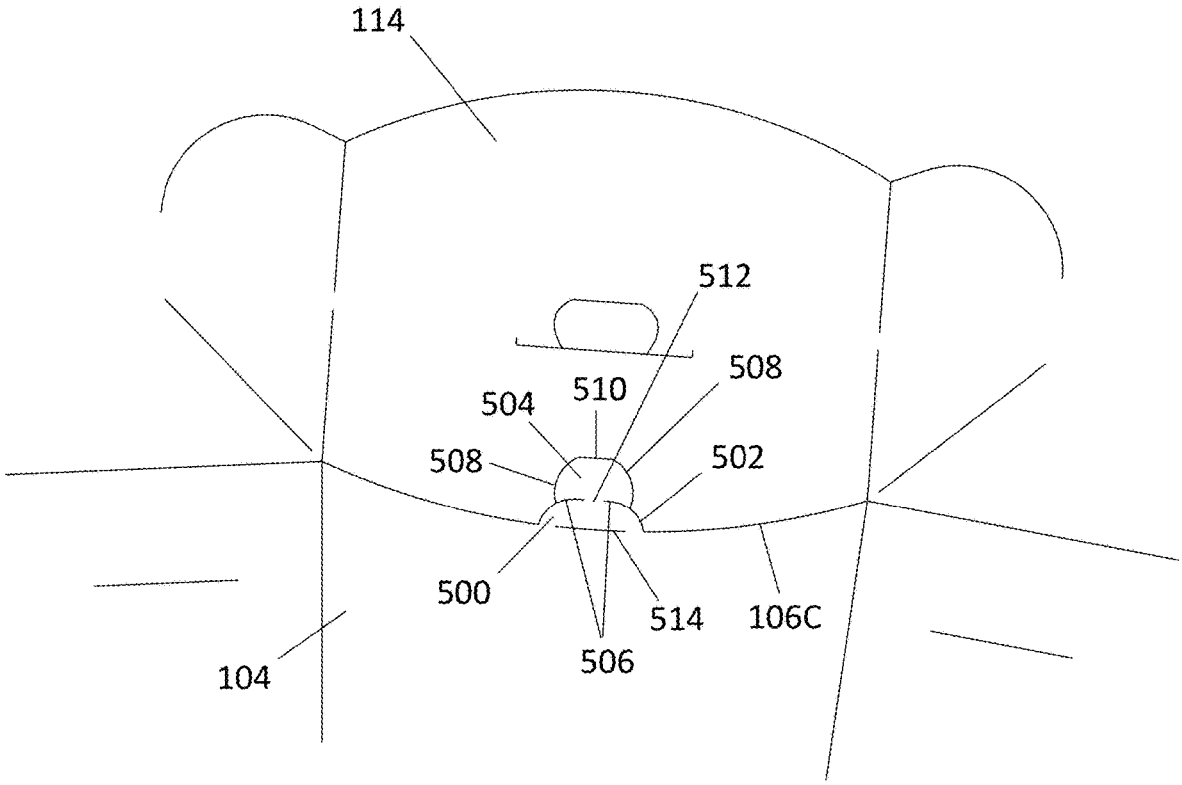
FIG. 5 shows an enlarged view of a section of a blank for forming a cup.

Referring to FIG. 5, a section of an exemplary blank for making a cup is shown. Other than the features discussed below, the features of the blank may be the same as those of the blank of FIGS. 2 and 3. Such features are not described again here.

A front flap 114 of the blank includes a spout portion 500. The spout portion 500 extends into the front flap 114 from the rim 106. In specific arrangements, the spout portion 500 extends from a front fold line 106C of the rim 106. In the exemplary arrangement shown in FIG. 5, the front fold line 106C is interrupted at the spout portion 500. That is, the front fold line 106C does not extend across a base of the spout portion 500. In some arrangements, this may mean that the spout portion 500 remains in position when the front flap 114 is folded over to form a part of the lid of the cup. In other arrangements, the connection between the spout portion 500 and the wall 104 may be foldable and may include a fold line.

An outer edge 502 of the spout portion 500 is separated from the front flap 114 by a cutline. The front flap 114 includes an aperture enlargement portion 504. The aperture enlargement portion 504 extends from the outer edge 502 of the spout portion 500 into the front flap 114. A part 506 of the outer edge 502 of the spout portion 500 forms a part of an edge of the aperture enlargement portion 504. A further part 508 of the outer edge of the aperture enlargement portion 504 is formed by a cutline or a frangible connection between the aperture enlargement portion 504 and the front flap 114. In the exemplary arrangement shown, a further part 510 of the outer edge of aperture enlargement portion 504 is foldably connected to the front flap 114 by, for example a fold line or other foldable connection.

The cutline forming the outer edge 506 of the spout portion 500 may be interrupted to form a connecting portion 512 between the spout portion 500 and the aperture enlargement portion 504. The connecting portion 512 forms a physical link between the spout portion 500 and the aperture enlargement portion 504. The connecting portion 512 restricts movement of the aperture enlargement portion 504 about the foldable connection 510 independent of the spout portion 500.

In the arrangement of FIG. 5, the connecting portion 512 holds the spout portion 500 in alignment with the aperture enlargement portion 504. This prevents snagging of either of these features when stacking cups.

The connecting portion 512 may be configured to break under a force applied by a user when folding over the front flap 114 to form the lid. In such arrangements, the spout portion 500 remains in position and forms a spout, as described above.

The connecting portion 512 may be configured to withstand the force applied by a user when folding over the front flap 114 to form the lid. In such arrangements, the spout portion 500 folds over with the front flap 114, providing a closed lid. To assist this action, a fold line 514 may be positioned at the bottom of the spout portion 500, where it meets the rim 106, although this feature is not essential.

The spout portion 500 may be lifted by a user inserting a fingernail through the cutline 506 and lifting the spout portion 500, breaking the connecting portion. The aperture enlargement portion 504 may be pushed through on application of a force in an inward direction by a user to form an enlarged aperture, for example by pushing a straw into the aperture enlargement portion 304 when the lid arrangement 108 is closed. This may be done after lifting the spout portion 500, or before.

A breaking strain of the connecting portion 512 may be determined by a thickness of the interruption of the cutline 506, or a thickness of the connecting portion 512.

It will be appreciated that there are numerous configurations of the spout portion 300, 500 and the aperture enlargement portion 504.

For example, the spout portion may be formed by a single spout cutline extending from the rim 106 into the front flap 114. The aperture enlargement portion may be formed by two enlargement cutlines, each extending from the spout cutline. Distal ends of the enlargement cutlines may be connected by a foldable part of the front flap 114.

In some examples, the single spout cutline may be interrupted by a connecting portion such that the spout portion and the aperture enlargement portion are connected, restricting independent movement of each. The connecting portion may be breakable under the force applied when folding the front flap 114 to form the lid of the cup. Alternatively, the connecting portion may be arranged to withstand the force applied when folding the front flap 114 to form the lid of the cup. In such arrangements, the spout portion may fold over with the front flap 114.

In other arrangements, the spout portion may be connected to the aperture enlargement portion by a frangible connection across a part of the outer edge of the spout portion that also forms a part of an edge of the aperture enlargement portion.

In other arrangements, the spout cutline may be replaced with a frangible connection and the two enlargement cutlines may be replaced with frangible connections.

Figure 6A:
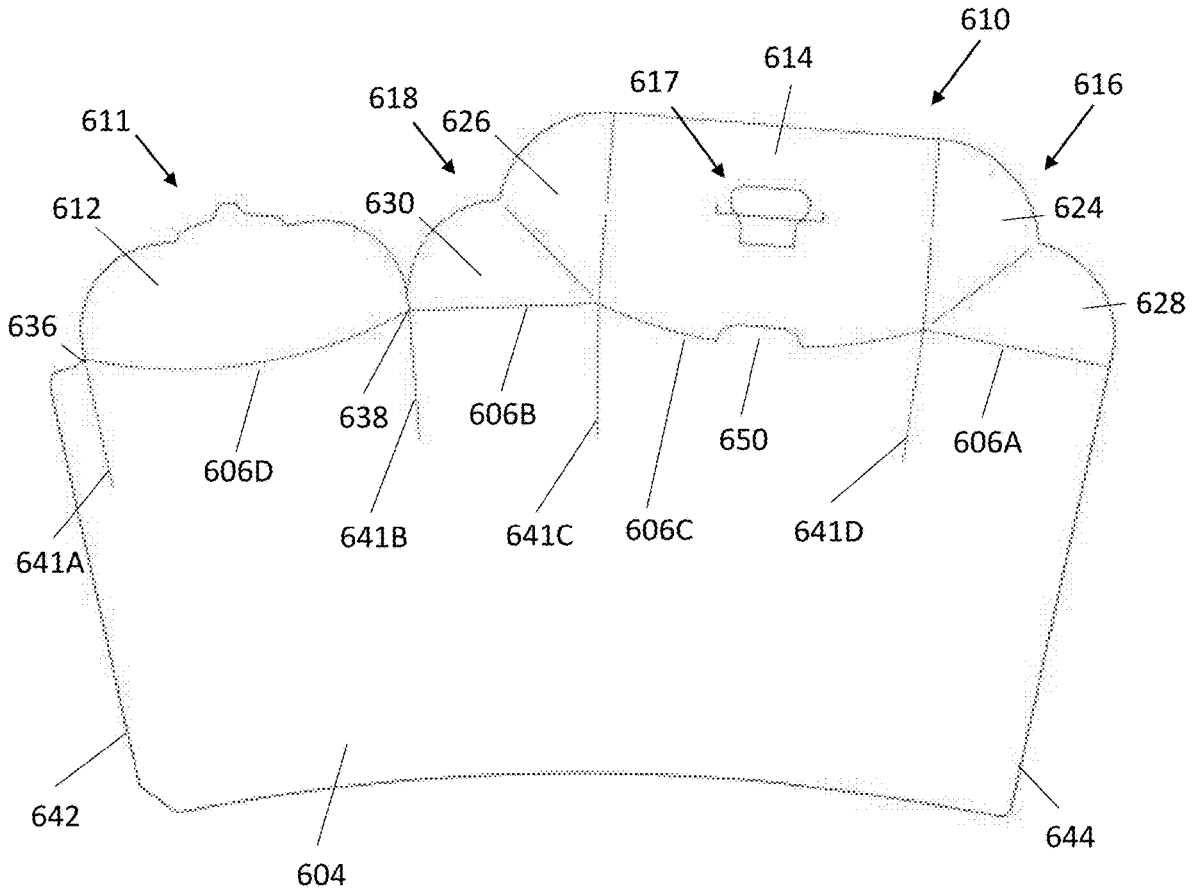
FIGS. 6A-6C show an exemplary blank for forming a cup.

FIG. 6A shows an exemplary blank for forming a cup. Some of the features of the blank may be the same as those of the blank of FIGS. 2 and 3 and some of those features are not discussed below. In exemplary arrangements, the blank may not include the aperture enlargement portion 304, as shown in FIG. 6A.

A lid arrangement comprises two flaps: a first closure flap 610, and a second (rear) closure flap 612. The first closure flap 610 and the second closure flap 612 extend vertically from the rim, generally in a direction continuing from a direction in which the wall 604 extends from the base. The first closure flap 610 extends around three sides of the generally rectangular rim. In the example shown in FIG. 6A, the first closure flap 610 extends around a front side and the two lateral sides of the rim.

The first closure flap 610 includes a front flap 614 and two side flaps 616, 618. The front flap 614 is foldable relative to the wall 604 about a fold line 606C, which forms the front side of the rim. The side flaps 616, 618 are adjacent to the front flap 614 and opposite each other. The side flaps 616, 618 are foldable relative to the wall 604 about fold lines 606A and 606B, which form lateral sides of the rim. The front flap 614 extends along an arced side of the generally rectangular rim. The second closure flap 612 is foldable relative to the wall 604 about a fold line 606D that forms a the rear side of the rim and is opposite the front flap 614 when the cup is formed. The rear fold line 606D and/or the front fold line 606C may be arced.

Each of the flaps of the lid arrangement 608 is foldable along a fold line coincident with a corresponding portion of the rim. In addition, each of the side flaps 616, 618 is foldably connected to the front flap along vertical fold lines. Further, each side flap 616, 618 comprises a front portion 624, 626 and a rear portion 628, 630. The front portions 624, 626 are connected to the front flap 614 at the vertical fold lines. The rear portions 628, 630 are connected to the wall 604 at the lateral fold lines 606A, 606B. The front portions 624, 626 and rear portions 628, 630 of each side flap 616, 618 are foldably connected along oblique fold lines.

When the cup is formed, the rear flap 612 is adjacent the rear portions 628, 630 of the side flaps 616, 618 at two corners 636, 638 of the generally rectangular rim. The rear flap 612 is not connected to the side flaps 616, 618. Notches are formed at the corners 636, 638 where the rear flap 612 and the rear portions 628, 630 of the side flaps 616, 618 extend downwards to the rim. The rear flap 612 is foldable independently of the side flaps 616, 618.

A side seam is formed on the wall 604 of the cup when formed. The seam is a result of creating the cup from a blank. The blank is wrapped around so that an edge 642 meets an edge 644, thereby creating the seam when the edges are joined. It will be seen that the edge 642 extends further than is necessary so as to form a flap that overlaps and is adhered to a corresponding portion of the wall 604 at the edge 644.

The seam runs from a corner 636 of the rim where the rear flap 612 is adjacent to one of the side flaps 616, 618. As a result, the seam stops at the rim and does not extend into any of the flaps of the lid arrangement. Accordingly, the seam does not interfere with the closing of the lid arrangement.

The wall 604 also includes rim forming fold lines 641A-D. These help create the substantially rectangular rim by encouraging the corners to be formed as the blank is folded around onto itself and formed into the cup.

The front flap 614 includes a spout portion 650. The spout portion 650 is configured to remain in position when the remainder of the front flap 614 is folded inwards when closing the lid arrangement. That is, the spout portion 650 remains in a position extending from the rim in a direction aligned with the wall 604 when the front flap 614 is folded inwards.

The front flap 614 is connected to the wall 604 along the front fold line 606C that forms an arced front side of the generally rectangular rim. The fold line 606C is interrupted at the spout portion 650. The fold line 606C stops and is interrupted at the spout portion 650. The spout portion 650 is a continuous extension of the wall 604. The spout portion 650 is not joined to the wall 604 by a fold line. An outer edge of the spout portion 650 extends into the front flap 614 and comprises a cut line or an otherwise frangible connection configured to break under a force applied to the front flap 614 when folding it inwards. Therefore, as the front flap 614 folds, the spout portion 650 remains in position. This leaves an aperture in the front flap 614 where the spout portion 650 was previously, and forms an extended spout to aid drinking.

It is noted that other spout arrangements disclosed herein may be used with the blank (and resulting cup) shown in FIG. 6A.

In the exemplary arrangement of FIG. 6A, a tongue 611 and/or a slit arrangement 617 are configured such that when the tongue 611 is engaged within the slit arrangement 617, vent apertures are created in the lid. The vent apertures may advantageously allow air from within the cup to escape to the outside. This allows a user to smell the contents of the cup when drinking. In some arrangements, the vent apertures may be generally aligned with the nostrils of a user during drinking. That is, when the mouth of the user is covering the spout 300 and the cup is tilted towards the user for drinking, the nostrils of the user may be substantially above the vent apertures.

Figure 6B:
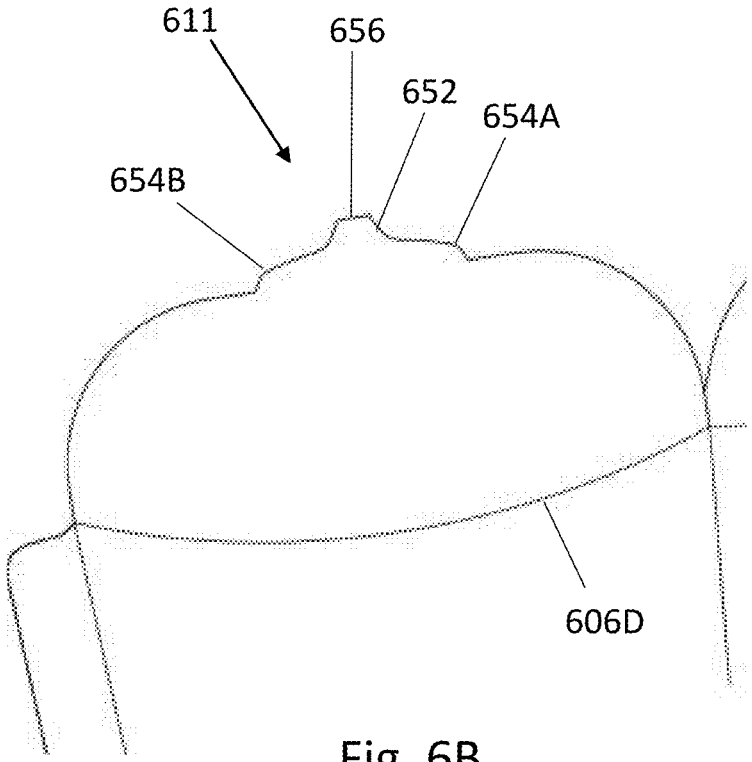

FIG. 6B shows an enlarged view of the tongue 611, which is formed on and extends from the rear flap 612. The tongue 611 comprise a neck 652 and shoulders 654A, 654B either side of the neck 652. The neck 652 extends beyond the shoulders 654A, 654B to form an elongate extension. In this example, a distal end 656 of the neck is flattened allowing it to but up against a surface. Optionally, the transition from the neck 652 to each shoulder 654A, 654B forms a concave curve. This increases a rigidity of the neck 654, especially when combined with the concave surface of the lid in a closed position formed by the rear flap 612 as it is folded about the fold line 606D. Optionally, each shoulder 654 is formed by a convex curve extending dow to the rear flap 612.

As discussed below, the tongue 611 interacts with the slit arrangement 617 to form apertures in the lid. In arrangements, the tongue 611 pushes a flap of the slit arrangement inwards for creating an aperture. The neck 652 intersects the aperture to create vent apertures in the space either side of the neck 652. The shoulders 654A, 654B may be held underneath a slit such that they sit beneath the front flap 614 and hold the tongue 611 in a position to keep the flap of the slit arrangement 617 pushed inwards.

Figure 6C:
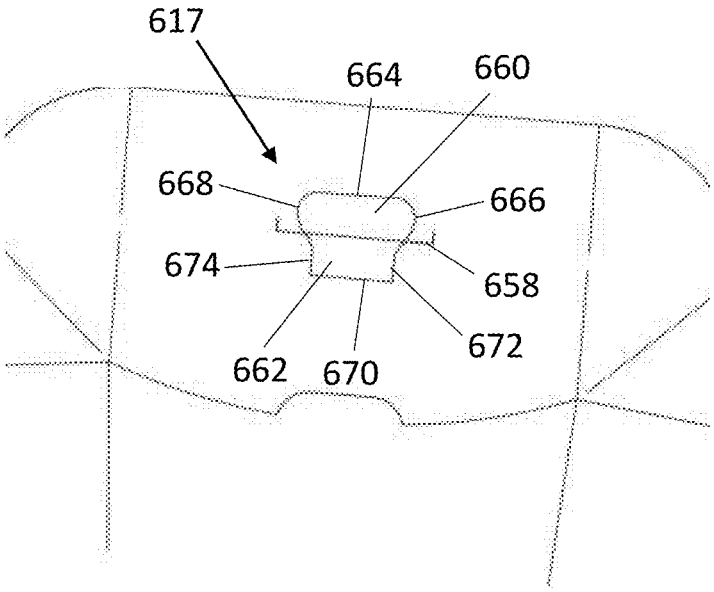

FIG. 6C shows an enlarged view of the slit arrangement 617 forming part of the front flap 614. The slit arrangement 617 comprises a lateral cut line 658. On one side of the lateral cut line 658 is a tongue receiving portion 662 of the slit arrangement 617. In some arrangements, on an opposite side of the lateral cut line 658 is a rear flap receiving portion 660 of the slit arrangement 617.

The rear flap receiving portion 660 forms a generally rectangular shape. A first edge of the generally rectangular shape of the rear flap receiving portion 660 is formed by at least part of the lateral cut line 658. A second edge 664 of the generally rectangular shape of the rear flap receiving portion 660 that is opposite to the first edge comprises at least one fold line. Third and fourth opposed edges 666, 668 of the generally rectangular shape of the rear flap receiving portion 660 are formed by cut lines. The third and fourth opposed edges 666, 668 form convex curves.

The tongue receiving portion 662 forms a generally rectangular shape. A first edge of the generally rectangular shape of the tongue receiving portion 662 is formed by at least part of the lateral cut line 658. A second edge 670 of the generally rectangular shape of the tongue receiving portion 662 that is opposite to the first edge comprises at least one fold line. Third and fourth opposed edges 672, 674 of the generally rectangular shape of the tongue receiving portion 662 are formed by cut lines. At least part of the third and fourth opposed edges 672, 674 form concave curves for producing shoulder retaining edges that are configured to retain the shoulders 654A, 654B of the tongue 611. A width of the tongue receiving portion 662 is, in this example, less than a width of the rear flap receiving portion 660.

In some exemplary arrangements, the fold line forming at least part of the second edge 670 of the tongue receiving portion 662 may cover less than the length of the second edge 670. At least part of the second edge 670 may be formed by one or more cut lines. For example, a cut line may form a portion of the second edge 670 at the location where the flatted end 656 of the neck 652 engages with the tongue receiving portion 662. Alternatively or in addition, further cut lines may form part of second edge 670. The tongue receiving portion 662 forms a flap, foldable inwards about the second edge 670.

The lateral cut line 658 extends beyond a width of the rear flap receiving portion 660 and/or the tongue receiving portion 662. The lateral cut line 658 includes portions to allow a portion of the front flap 614 to be folded inwards.

Figure 6D:
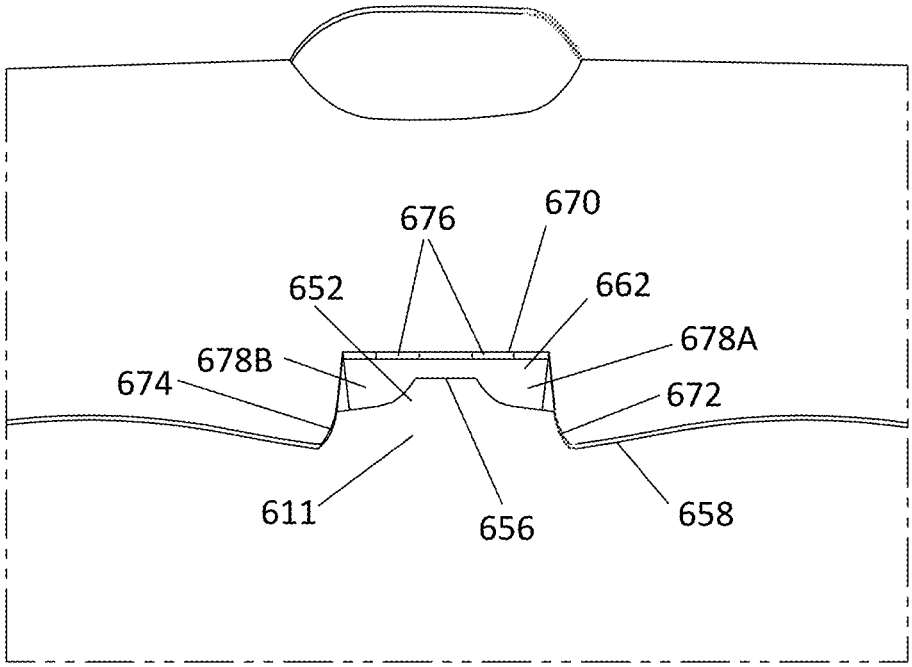
FIG. 6D shows a top view of a cup with the lid arrangement in a closed configuration.

FIG. 6D shows a top view of a cup with the lid arrangement in a closed position. The lid arrangement may be closed in a similar fashion to the method described in respect of FIGS. 4A-4F. When the user pushes downwards on the rear flap 612, the neck 652 pushes the tongue receiving portion 662 inwards, which folds inwards about the second edge 670. In the exemplary arrangement of FIG. 6D, the second edge 670 comprises two fold lines 676 and three cut lines. The fold lines 676 are positioned either side of the flattened end 656 of the neck 652.

The shoulders 654A, 654B are received and retained beneath the shoulder retaining edges formed by the concave curved regions of the third and fourth edges 672, 674 of the tongue receiving portion 662. The pushing down of the rear flap 612 by the user will allow the shoulders 654A, 654B to deform and snap under the third and fourth edges 672, 674 where they are retained.

Because the shoulders 654A, 654B are retained under the third and fourth edges 672, 674 of the tongue receiving portion 662, the neck 652 is held at a position lower than the surface of the lid. The flattened end 656 of the neck 652 therefore abuts against the tongue receiving portion 652, which is thereby retained in the inwardly folded position.

This creates vent apertures 678A, 678B. The features of the lid arrangement may be dimensioned such that the vent apertures are aligned with the nostrils of a user when drinking.

It will be appreciated that the features described above may be applied to other cups and/or lids of cups. For example, the features described above may be applied to a separately fitted cup lid, which may be a plastic cup lid. Accordingly, a lid arrangement of a cup may comprise a foldable flap. The foldable flap may form part of a lid closure arrangement, similar to those discussed above, or may be a liftable flap forming a part of a lid, e.g. a liftable flap to create a drinking aperture. The foldable flap may comprise a tongue extending therefrom. The tongue may comprise a neck and shoulders, as described above. The lid may further comprise a slit arrangement. The slit arrangement may comprise a lateral cut line and a tongue receiving portion. At least one edge of the tongue receiving portion may be formed by the lateral cut line. At least one edge of the tongue receiving portion may include a fold line and at least one further cut line to form an inwardly foldable flap. In use, the foldable flap may be lifted and folded over onto the lid such that the neck engages the tongue receiving portion, folding it inwards and creating a vent aperture. The shoulders are retained under edges of the tongue receiving portion (or by another retaining mechanism), holding the neck in place and holding open the vent aperture.

Figure 7A:
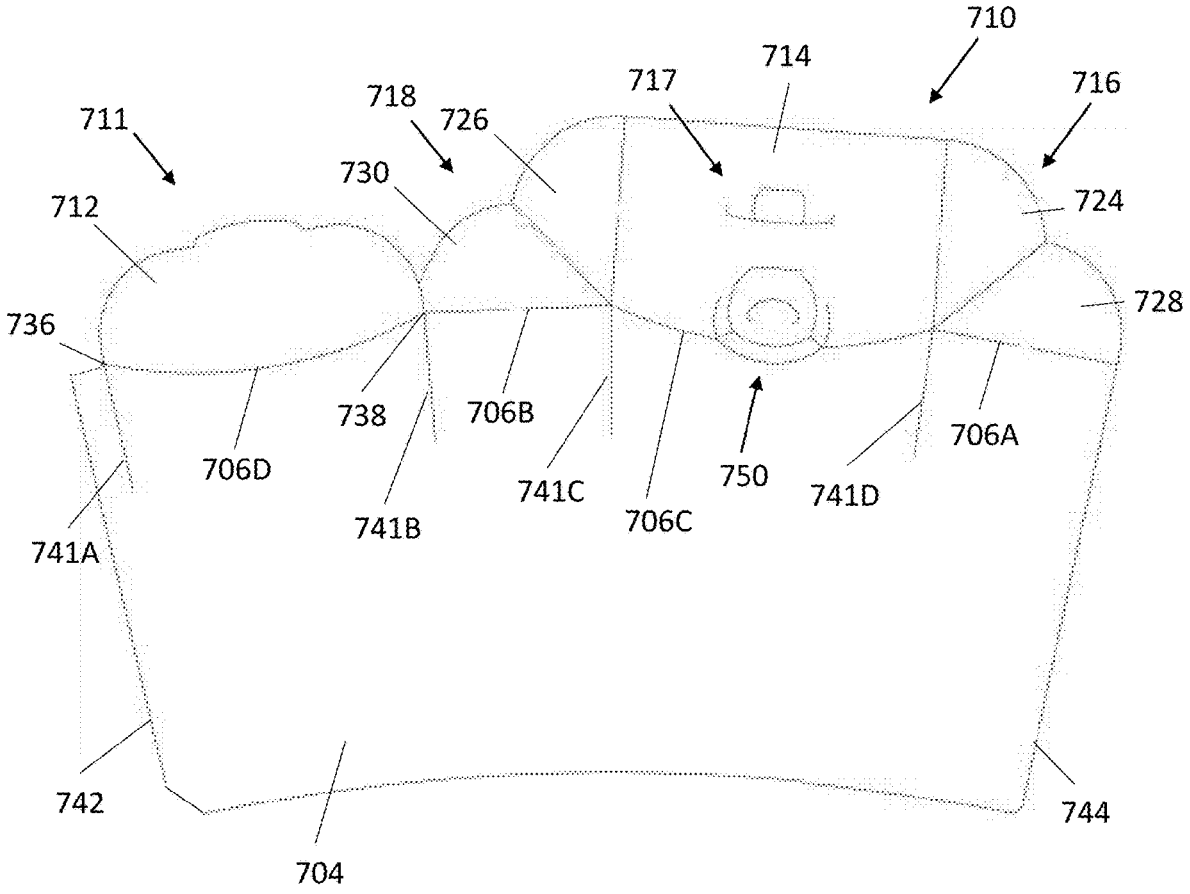
FIGS. 7A-7B show an exemplary blank for forming a cup.

FIG. 7A shows an exemplary blank for making a cup. Some of the features of the blank may be the same as those of the blank of FIGS. 2 and 3. In exemplary arrangements, the spout of the blank of FIG. 7A may differ from those described above and/or the blank may not include the aperture enlargement portion 304, as shown in FIG. 7A.

A lid arrangement comprises two flaps: a first (front) closure flap 710, and a second (rear) closure flap 712. The first closure flap 710 and the second closure flap 712 extend vertically from the rim in a direction continuing from a direction in which the wall 704 extends from the base. The first closure flap 710 extends around three sides of the generally rectangular rim. In the example shown in FIG. 7A, the first closure flap 710 extends around a front side and the two lateral sides of the rim.

The first closure flap 710 includes a front flap 714 and two side flaps 716, 718. The front flap 714 is foldable relative to the wall 704 about a fold line 706C, which forms the front side of the rim. The side flaps 716, 718 are adjacent to the front flap 714 and opposite each other. The side flaps 716, 718 are foldable relative to the wall 704 about fold lines 706A and 706B, which form lateral sides of the rim. The front flap 714 extends along an arced side of the generally rectangular rim. The second closure flap 712 is foldable relative to the wall 704 about a fold line 706D that forms the rear side of the rim and is opposite the front flap 714. The rear fold line 706D may be arced.

Each of the flaps of the lid arrangement 708 is foldable along a fold line coincident with a corresponding portion of the rim. In addition, each of the side flaps 716, 718 is foldably connected to the front flap along vertical fold lines. Further, each side flap 716, 718 is split into a front portion 724, 726 and a rear portion 728, 730. The front portions 724, 726 are connected to the front flap 714 by the vertical fold lines. The rear portions 728, 730 are connected to the wall 704 by the lateral fold lines 706A, 706B. The front portions 724, 726 and rear portions 728, 730 of each side flap 716, 718 are foldably connected along oblique fold lines.

The rear flap 712 is adjacent the rear portions 728, 730 of the side flaps 716, 718 at two corners 736, 738 of the generally rectangular rim. The rear flap 712 is not connected to the side flaps 716, 718. Notches are formed at the corners 736, 738 where the rear flap 712 and the rear portions 728, 730 of the side flaps 716, 718 extend downwards to the rim. The rear flap 712 is foldable independently of the side flaps 716, 718.

A side seam is formed on the wall 704 of the cup when formed. The seam is a result of creating the cup from a blank. The blank is wrapped around so that an edge 742 meets an edge 744, thereby creating the seam when the edges are joined. It will be seen that the edge 742 extends further than is necessary so as to form a flap that overlaps and is adhered to a corresponding portion of the wall 704 at the edge 744.

The seam runs from a corner 736 of the rim where the rear flap 712 is adjacent to one of the side flaps 716, 718. As a result, the seam stops at the rim and does not extend into the lid arrangement. Accordingly, the seam does not interfere with the closing of the lid arrangement.

The wall 704 also includes rim forming fold lines 741A-D. These help create the substantially rectangular rim by encouraging the corners to be formed as the blank is formed into the cup.

Figure 7B:
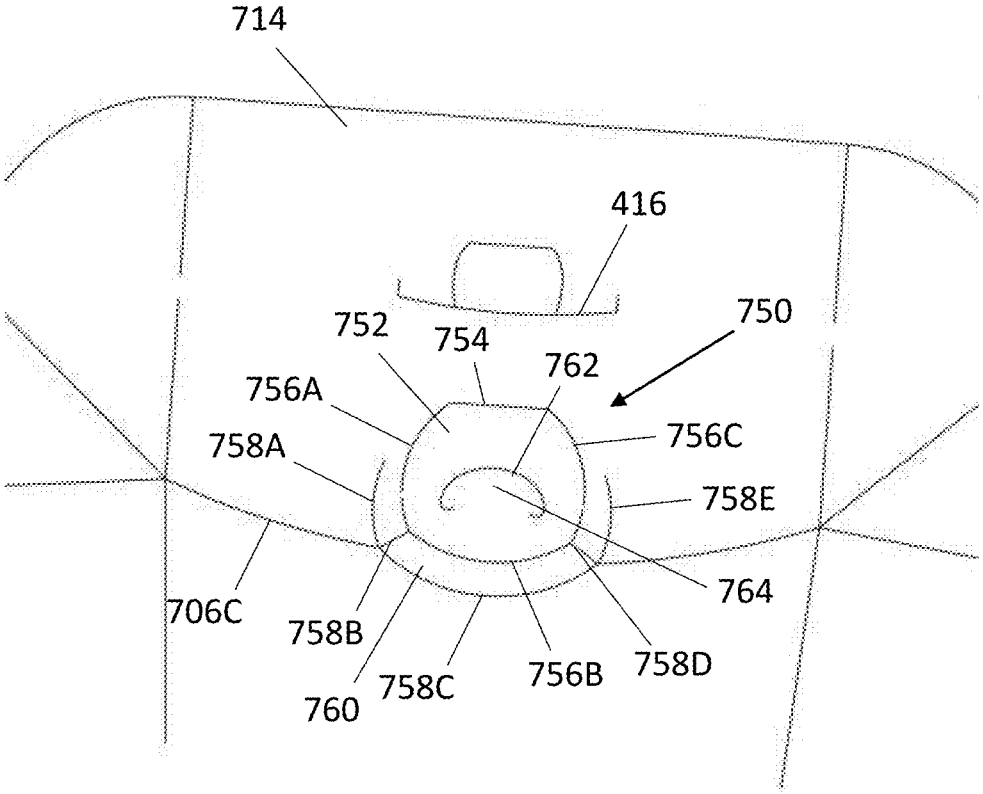

The front flap 714 includes a spout portion 750, which is shown in greater detail in FIG. 7B.

In exemplary arrangements, the spout portion 750 includes a liftable flap 752. The liftable flap is connected to the front flap 714 by a fold line 754. The remaining edges of the liftable flap 752 may be formed by cut lines 756A-C such that the liftable flap 752 is foldable inwards and/or outwards. One or more frangible connections (or perforations) between the liftable flap 752 and the front flap 714 may interrupt the cut lines 756A-B to prevent unwanted movement of the liftable flap 752 about the fold line 754.

The cutline 756B forms a convex curve. In exemplary arrangements, a part of the cut line 756B may interrupt and extend below a fold line about which the front flap 714 is folded, e.g. the front fold line 706C. Accordingly, when the front flap 714 is folded about the fold line, the liftable flap 752 remains aligned with (and optionally connected to, via the frangible connections) the front flap 714 and the cut line 756B forms a lip protruding from the wall 704 of the cup allowing a user to gain purchase for lifting the liftable flap. It is noted that a convex curved cut line 756B is not essential and any other form of projection below the fold line may be used.

In the exemplary arrangement shown in FIGS. 7A and 7B, spout forming fold lines 758A-E are formed. Fold line 758C forms a deviation of the fold line 706C. That is, a deviation form the arc of the front fold line 706C. In the example shown in FIGS. 7A and 7B, the deviation fold line forms a convex curve extending from the front fold line 706C into the wall 704. Oblique spout forming fold lines 758B and 758D extend from the deviation fold line 758C to the cut line 756B of the liftable flap 752. In the example shown in FIGS. 7A and 7B, the oblique fold lines extend from a junction of the front fold line 706C and the deviation fold line 758C. In the example shown in FIGS. 7A and 7B, the oblique fold lines meet the edge of the liftable flap 752 at a junction between the cutlines 756A and 756B and at a junction between the cutlines 756C and 756B.

Figure 7C:
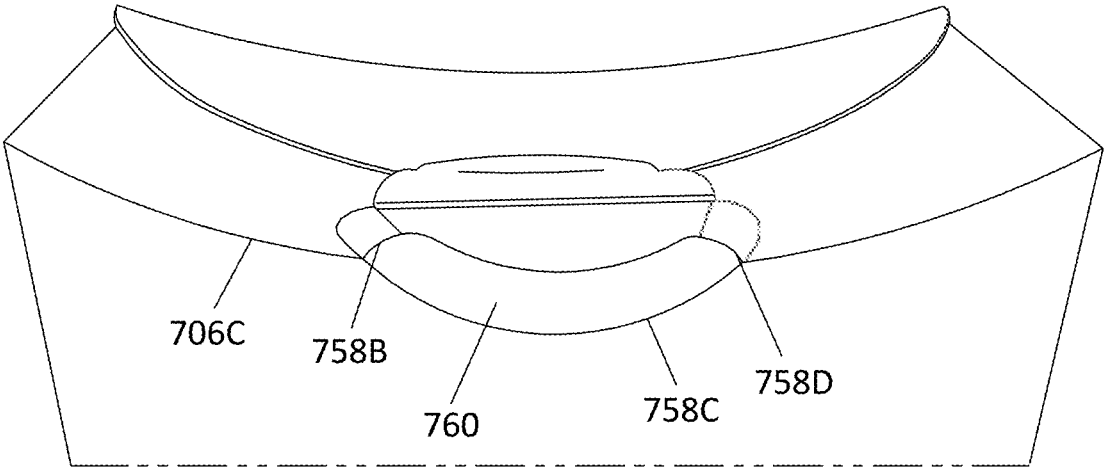
FIG. 7C shows a side view of a cup with the lid arrangement in a closed configuration.

The fold line 706C, the oblique spout forming fold lines 758B and 758D and the deviation fold line 758C are configured such that the front flap 714 folds about a line formed by the combination of the fold line 706C, the oblique spout forming fold lines 758B and 758C and the cut line 756B. As shown in FIG. 7C, this results in a spout region 760 being formed that extends from the wall 704 and stands proud of the surface of the lid. The spout region 760 is the region between the deviation fold line and the cutline 756B.

Spout raising fold lines 758A and 758E extend from the front fold line 706C into the front flap 714. In the exemplary arrangement of FIGS. 7A-7C, the spout raising fold lines 758A and 758E extend from the front fold line 706C at the junctions between the front fold line 706C and the deviation fold line 758C. The spout raising fold lines are angled inwards towards each other. As the front flap 714 is folded about the line formed by the combination of the fold line 706C, the oblique spout forming fold lines 758B and 758C and the cut line 756B, the spout raising fold lines 758A and 758E cause the edges 756A-C of the liftable flap 752 to be raised to form a spout. In the example shown in FIGS. 7A and 7B, the spout raising fold lines are curved inwards and angled towards the liftable flap 752.

The arrangement described above results in the convex cutline 756B forming a lip that does not leave an aperture in the sidewall 704 of the formed cup, as can be seen in FIG. 7C. This helps prevent leaks.

A clasp cutline 762 is formed on the liftable flap 752. The clasp cutline is positioned such that when the liftable flap 752 is folded onto the surface of the lid, a region of the liftable flap 752 may be tucked under the slit 416. The clasp cutline 762 is curved such that a clasp portion 764 of the liftable flap 752 may be positioned against the slit 416, allowing a remainder of the liftable flap 752 to form a lever. Pushing the lever towards the surface of the lid tucks the clasp portion 764 into the slit 416 and under the front flap 714. This holds the spout in an open position for drinking.

Figure 8A:
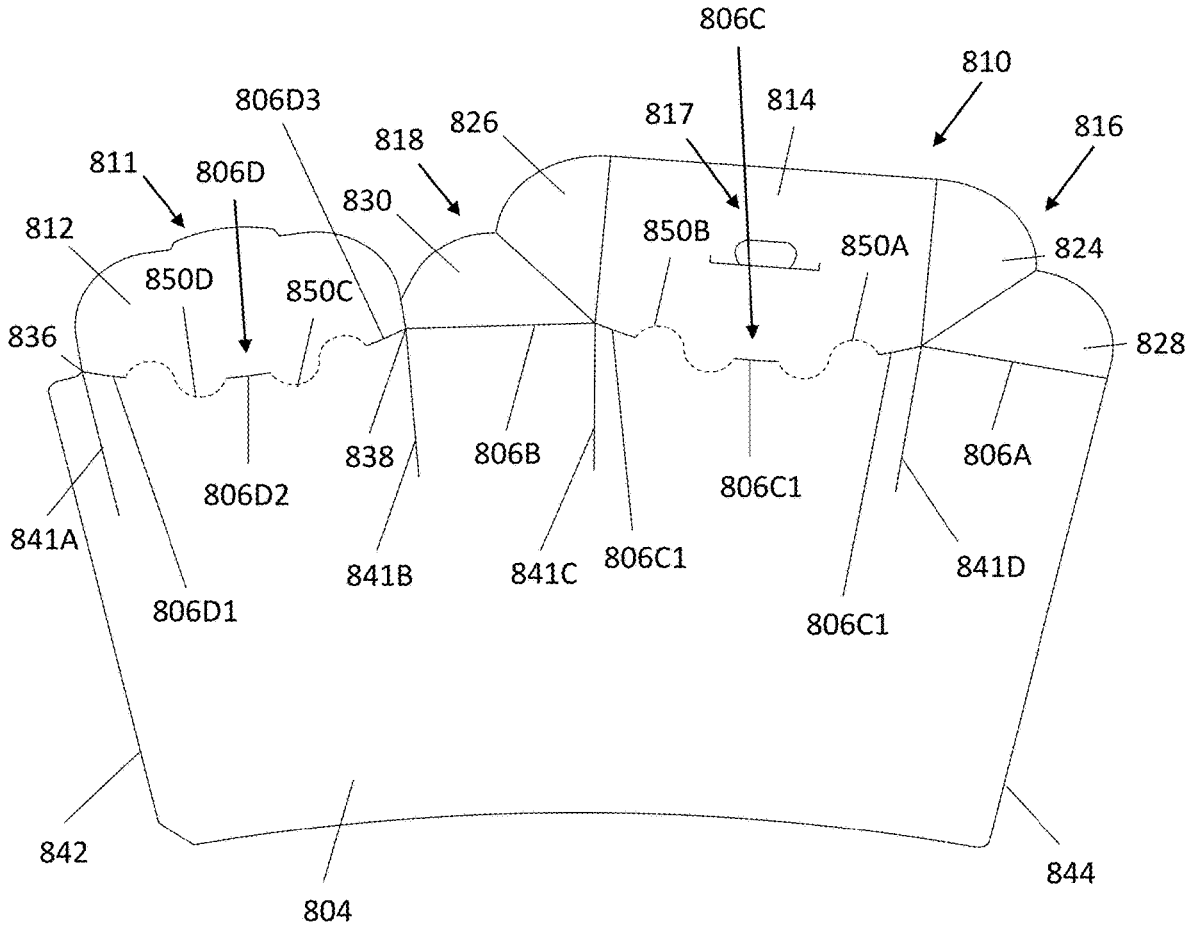
FIG. 8A shows an exemplary blank for forming a cup.

FIG. 8A shows an exemplary blank for forming a cup. Some of the features of the blank may be the same as those of the blank of FIGS. 2 and 3 and some of those features are not discussed again below. In exemplary arrangements, the blank may not include the aperture enlargement portion 304 or the spout portion 300, as in the blank shown in FIG. 8A. Accordingly, the blank shown in FIG. 8A may be suitable for containing food items.

A lid arrangement comprises two flaps: a first closure flap 810, and a second (rear) closure flap 812. The first closure flap 810 and the second closure flap 812 extend vertically from the rim, generally in a direction continuing from a direction in which the wall 804 extends from the base. The first closure flap 810 extends around three sides of the generally rectangular rim. In the example shown in FIG. 8A, the first closure flap 810 extends around a front side and the two lateral sides of the rim.

The first closure flap 810 includes a front flap 814 and two side flaps 816, 818. The front flap 814 is foldable relative to the wall 804 about a fold line 806C, which forms the front side of the rim. The side flaps 816, 818 are adjacent to the front flap 814 and opposite each other. The side flaps 816, 818 are foldable relative to the wall 804 about fold lines 806A and 806B, which form lateral sides of the rim. The front flap 814 extends along an arced side of the generally rectangular rim. The second closure flap 812 is foldable relative to the wall 804 about a fold line 806D that forms a the rear side of the rim and is opposite the front flap 814 when the cup is formed. The rear fold line 806D and/or the front fold line 806C may be arced.

Each of the flaps of the lid arrangement 808 is foldable along a fold line coincident with a corresponding portion of the rim. In addition, each of the side flaps 816, 818 is foldably connected to the front flap along vertical fold lines. Further, each side flap 816, 818 comprises a front portion 824, 826 and a rear portion 828, 830. The front portions 824, 826 are connected to the front flap 814 at the vertical fold lines. The rear portions 828, 830 are connected to the wall 804 at the lateral fold lines 806A, 806B. The front portions 824, 826 and rear portions 828, 830 of each side flap 816, 818 are foldably connected along oblique fold lines.

When the cup is formed, the rear flap 812 is adjacent the rear portions 828, 830 of the side flaps 816, 818 at two corners 836, 838 of the generally rectangular rim. The rear flap 812 is not connected to the side flaps 816, 818. Notches are formed at the corners 836, 838 where the rear flap 812 and the rear portions 828, 830 of the side flaps 816, 818 extend downwards to the rim. The rear flap 812 is foldable independently of the side flaps 816, 818.

A side seam is formed on the wall 804 of the cup when formed. The seam is a result of creating the cup from a blank. The blank is wrapped around so that an edge 842 meets an edge 844, thereby creating the seam when the edges are joined. It will be seen that the edge 842 extends further than is necessary so as to form a flap that overlaps and is adhered to a corresponding portion of the wall 804 at the edge 844.

The seam runs from a corner 836 of the rim where the rear flap 812 is adjacent to one of the side flaps 816, 818. As a result, the seam stops at the rim and does not extend into any of the flaps of the lid arrangement. Accordingly, the seam does not interfere with the closing of the lid arrangement.

The wall 804 also includes rim forming fold lines 841A-D. These help create the substantially rectangular rim by encouraging the corners to be formed as the blank is folded around onto itself and formed into the cup.

The exemplary arrangement shown in FIG. 8A includes vent cut lines 850A-D that interrupt the fold lines 806C, 806D. The vent cut lines 850A, 850B extend into the front flap 814 above the fold line 806C. The vent cut lines 850A-D may extend into the respective closure flaps 814, 812 and/or into the wall 804. For example, in FIG. 8A, the vent cut lines 850A, 850B extend into the front flap 814 above the fold line 806C, and into the wall 804 below the fold line 806C. The vent cut lines 850C, 850D extend into the rear flap 812 above the fold line 806D, and into the wall 804 below the fold line 806D.

Accordingly, one or more of the vent cut lines 850A-D form lines that oscillate about a respective fold line 806C, 806D. That is, one or more vent cut lines 850A-D may extend away from the respective fold line 806C, 806D into the respective closure flaps 814, 812, changes direction to cross the respective fold line 806C, 806D, extends into the wall 804, and changes direction to return to the respective fold line 806C, 806D.

In the exemplary arrangement shown in FIG. 8A, the vent cut lines 850A-D form an S-shape.

However, the skilled person will understand that the vent cut lines 850A-D may form a number of further shapes that oscillate about the respective fold line 806C, 806D, e.g. a sawtooth shape, square wave shape, a regular or irregular sinusoidal shape, as well as many other regular or irregular shapes.

In the exemplary arrangement shown in FIG. 8A, a distance the vent cut lines 850A-D extend above the respective fold line 806C, 806D is the same as the distance the vent cut lines 850A-D extend below the respective fold line 806C, 806D. However, the skilled person will appreciate that this need not be the case.

In the exemplary arrangement shown in FIG. 8A, a distance from a start of the vent cut lines 850A-D to a crossover point of the vent cut lines 850A-D is the same as a distance from the crossover point to an end of the vent cut lines 850A-D. However, the skilled person will appreciate that this need not be the case.

Two vent cut lines 850A-B are formed along the fold line 806C. In the exemplary arrangement of FIG. 8A, the fold line 806C comprises three sections 806C1, 806C2, 806C3 and the vent cut lines 850A, 850B connect the three sections. The sections 806C2, 806D2 may be positioned centrally along a length of the fold line 806C, 806D. This provides additional stability to the front closure flap 814, as explained below.

In exemplary arrangements, a similar structure may be used for the fold line 806D, which comprises three sections 806D1, 806D2, 806D3 connected by the two vent cut lines 850C-D.

Figure 8B:
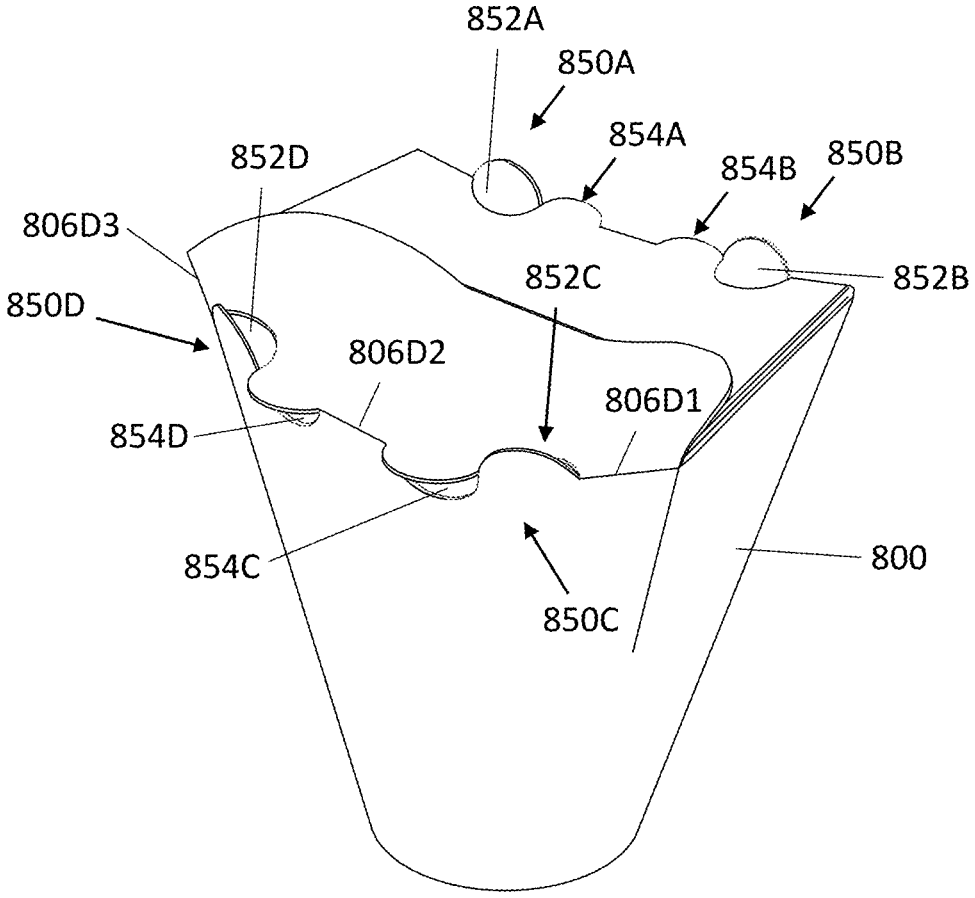
FIG. 8B shows an isometric view of a cup when a lid arrangement is in a closed position.

FIG. 8B shows a cup 800 formed from the blank sown in FIG. 8A. In the view of the cup shown in FIG. 8B, the lid arrangement is in the closed position, which may be achieved using a process similar to that described above in respect of FIGS. 4A-4E.

As can be seen in FIG. 8B, when the lid arrangement is closed, each vent cut line 850A-D forms a lid vent 852A-D and a wall vent 854A-D. These vents allow steam to escape from the cup and thereby allow hot food to remain crisp, preventing it from becoming soggy.

Because the vent cut lines 850A-D oscillate about their respective fold line 806C, 806D vents are formed in the lid and in the wall 804. Accordingly, a greater area of vent may be provided without creating single large apertures in the lid or wall, thereby reducing rigidity in the cup 800. In addition, not all of the vent area is in the lid, thereby reducing the risk of foreign objects entering the cup 800.

Further, the three sections of the fold lines 806C, 806D increase rigidity of the lid. This is particularly true of the central sections 806C2, 806D2. The central sections 806C2, 806D2 are aligned with the tongue of the rear flap 812 and the slit of the front flap 814 (see FIGS. 4B and 4C). This arrangement means that when the rear flap 812 is depressed during closing such that the tongue is inserted into the slit, there is no downward movement of the rear flap 812 or the front flap 814 at the point where it meets the wall 804. The central sections 806C2, 806D2 resist downward pressure applied by the user during closing.

Additional rigidity is provided because the vent cut lines 850A-D oscillate about the respective fold line 806C, 806D. When the lid arrangement is folded closed, the oscillation of the vent cut lines 850A-DS results in tabs that extend beyond the cup and are transverse to each other.

For each vent cut line 850A-D, a first tab extends upwards from the wall 804, and a second tab extends laterally outward from the rear flap 812 or the front flap 814, respectively. The second tab extends over the wall vent 854A-D that it has formed when the lid arrangement has been folded. Accordingly, downward force on the rear flap 812 or the front flap 814 (e.g. during closing of the lid arrangement) attempts to force the second tab into the wall vent 854A-D. Because the wall vent 854A-D narrows as it extends downwards into the wall 804, such downward force on the rear flap 812 or the front flap 814 is resisted by the second tab, which cannot move into the narrowing wall vent 854A-D. In a similar way, lateral force is resisted by the first tab.

It will be apparent to those skilled in the art that various modifications and variations can be made to the disclosed systems and methods. Other embodiments will be apparent to those skilled in the art from consideration of the specification and practice of the disclosed systems and methods. It is intended that the specification and examples be considered as exemplary only, with a true scope being indicated by the following claims and their equivalents.

The invention claimed is:

1. A cup, comprising:

a base;

a wall extending from the base to a rim of the cup; and a lid arrangement including a flap extending from the rim and foldable inwards about a fold line coincident with at least part of the rim, to form at least part of a lid of the cup, wherein a part of the flap defines a spout portion extending from the rim and separable from the flap along an edge of the spout portion, and wherein a further part of the flap defines an aperture enlargement portion extending from the edge of the spout portion and separable from the flap and the spout portion along at least a part of an edge of the aperture enlargement portion.

2. The cup according to claim 1, wherein the edge of the spout portion comprises a cutline formed in the flap.

3. The cup according to claim 1, wherein the edge of the aperture enlargement portion comprises a cutline extending from the edge of the spout portion.

4. The cup according to claim 3, wherein the edge of the aperture enlargement portion comprises two cutlines extending from the edge of the spout portion, and wherein distal ends of the two cutlines are connected by a foldable connection allowing the aperture enlargement portion to be folded relative to the flap.

5. The cup according to claim 1, wherein the edge of the spout portion comprises a frangible connection between the spout portion and the flap.

6. The cup according to claim 1, wherein the edge of the aperture enlargement portion comprises a frangible connection extending from the edge of the spout portion.

7. The cup according to claim 1, wherein the spout portion is frangibly connected to the aperture enlargement portion such that the spout portion and the aperture enlargement portion are retained in alignment.

8. The cup according to claim 7, wherein the frangible connection between the spout portion and the aperture enlargement portion is configured to break under a force applied by a user when folding the flap inwards.

9. The cup according to claim 7, wherein the frangible connection between the spout portion and the aperture enlargement portion is configured not to break under a force applied by a user when folding the flap inwards.

10. The cup according to claim 1, wherein the spout portion is configured to be separable from the flap upon the flap being folded about the fold line to form a spout from which liquid may flow out of the cup.

11. The cup according to claim 1, wherein the fold line is interrupted where the spout portion extends from the rim.

12. The cup according to claim 1, wherein the fold line is arced outwards in a plane parallel with the base, such that the spout includes a singly curved surface.

13. The cup according to claim 1, wherein separation of the spout portion from the flap creates an aperture in the lid.

14. The cup according to claim 1, wherein at least a part of the edge of the aperture enlargement portion is foldably connected to the flap, such that the aperture enlargement portion may be folded inwards on application of an inward force.

15. The cup according to claim 1, wherein the aperture enlargement portion and/or the spout portion accommodate a drinking straw inserted into the enlarged aperture.

16. The cup according to claim 15, wherein the aperture enlargement portion and/or the spout portion are sized such that at least one internal dimension of the enlarged aperture is substantially equal to an outer dimension of the drinking straw.

17. The cup according to claim 15, wherein at least a part of an outer edge of the aperture enlargement portion is shaped to follow an outer dimension of the drinking straw.

18. The cup according to claim 1, wherein the flap is a front flap and the fold line is a front fold line, and the lid arrangement further includes a rear flap extending from an opposite side of the rim to the front flap, and wherein the rear flap is foldable inwards about a rear fold line to form at least a part of the lid of the cup.

19. The cup according to claim 18, wherein the front flap extends from the rim by a distance substantially equal to a distance from the front fold line to the rear fold line, and wherein the rear flap extends from the rear fold line by a distance less than a distance to an outer edge of the aperture.

20. The cup according to claim 18, further comprising a pair of opposed side flaps extending from the rim and foldable inwards about lateral fold lines to form at least a part of the lid of the cup.

21. The cup according to claim 20, wherein the pair of opposed side flaps include a front portion and a rear portion, wherein the rear portion is foldable about the lateral fold lines, wherein the front portion is foldably connected to the front flap, and wherein the front and rear portions are foldable connected along oblique fold lines.

22. The cup according to claim 20, wherein the rear flap is not connected to the front flap or either of the pair of opposed side flaps.

23. The cup according to claim 18, wherein the fold line comprises one or more vent cut lines, each vent cut line forming a shape that oscillates about the fold line such that, when the flap is folded about the fold line, each vent cut line forms a lid vent and a wall vent.

24. The cup according to claim 23, wherein the rear fold line comprises one or more further vent cut lines, each further vent cut line forming a shape that oscillates about the rear fold line such that, when the rear flap is folded about the rear fold line, each further vent cut line forms a lid vent and a wall vent.

25. The cup according to claim 6, wherein the flap is a front flap and the fold line is a front fold line, and the lid arrangement further includes a rear flap extending from an opposite side of the rim to the front flap, wherein the rear flap is foldable inwards about a rear fold line to form at least a part of the lid of the cup, wherein the rear flap extends from the rear fold line by a distance less than a distance to an outer edge of the aperture, and wherein the rear flap extends from the rear fold line by a distance less than a distance from the rear fold line to an outer edge of the enlarged aperture.

* * * * *